US011624524B2

(12) United States Patent
Noboa et al.

(10) Patent No.: US 11,624,524 B2
(45) Date of Patent: Apr. 11, 2023

(54) SYSTEMS AND METHODS FOR EXPEDITED FLOW SENSOR CALIBRATION

(71) Applicant: Johnson Controls Technology Company, Auburn Hills, MI (US)

(72) Inventors: Homero L. Noboa, Waukesha, WI (US); Kirk H. Drees, Cedarburg, WI (US); Jack A. Peterson, Brookfield, WI (US); Brennan H. Fentzlaff, Oconomowoc, WI (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 400 days.

(21) Appl. No.: 16/730,798

(22) Filed: Dec. 30, 2019

(65) Prior Publication Data

US 2021/0199330 A1 Jul. 1, 2021

(51) Int. Cl.

| | |
|---|---|
| ***F24F 11/49*** | (2018.01) |
| ***F24F 11/65*** | (2018.01) |
| ***F24F 11/74*** | (2018.01) |
| ***F24F 11/64*** | (2018.01) |
| *F24F 110/30* | (2018.01) |
| *F24F 11/50* | (2018.01) |

(52) U.S. Cl.

CPC ..... *F24F 11/49* (2018.01); *F24F 11/64* (2018.01); *F24F 11/65* (2018.01); *F24F 11/74* (2018.01); *F24F 11/50* (2018.01); *F24F 2110/30* (2018.01)

(58) Field of Classification Search

CPC .. F24F 11/49; F24F 11/64; F24F 11/74; F24F 2110/30

See application file for complete search history.

(56) References Cited

U.S. PATENT DOCUMENTS

| | | | | |
|---|---|---|---|---|
| 3,946,757 | A | 3/1976 | Wallace | |
| 4,431,020 | A | 2/1984 | Kowalski | |
| 5,107,713 | A * | 4/1992 | Peck | G01N 1/24 700/282 |
| 5,904,292 | A | 5/1999 | McIntosh | |

(Continued)

FOREIGN PATENT DOCUMENTS

| | | | |
|---|---|---|---|
| CH | 711558 | A1 | 3/2017 |
| CN | 2777312 | Y | 5/2006 |

(Continued)

OTHER PUBLICATIONS

Belimo Aircontrols (USA), Inc. "Belimo Energy Valve Technical Documentation," www.EnergyValve.com (Apr. 2017).

(Continued)

*Primary Examiner* — Mohammad Ali
*Assistant Examiner* — Vincent W Chang
(74) *Attorney, Agent, or Firm* — Foley & Lardner LLP

(57) ABSTRACT

A method for calibrating a flow sensor in a heating, ventilation, or air conditioning (HVAC) system. The method includes receiving, at a controller, a request to enter a calibration mode and, in response to receiving the request, automatically commanding a flow control device to achieve a target flow rate. The method further includes generating, by the controller, calibration data for the flow sensor using a reference flow value of the flow rate when the flow control device has achieved the target flow rate and a corresponding flow measurement from the flow sensor.

20 Claims, 14 Drawing Sheets

(56) References Cited

U.S. PATENT DOCUMENTS 6,343,617 B1 2/2002 Tinsley et al.
6,352,106 B1 3/2002 Hartman
7,096,093 B1 8/2006 Hansen et al.
7,231,931 B2 6/2007 Lull et al.
7,266,427 B2 9/2007 Hansen et al.
7,434,477 B2 10/2008 Lull et al.
7,798,170 B2 9/2010 Hotz et al.
8,109,289 B2 2/2012 Trnka et al.
8,833,384 B2 9/2014 Burt
9,658,628 B2 5/2017 Burt
9,874,880 B2 1/2018 Thuillard et al.
2002/0117214 A1 8/2002 Tucker et al.
2003/0125840 A1 7/2003 Lunzman
2007/0012367 A1 1/2007 Hotz et al.
2008/0110236 A1 5/2008 Hajishah et al.
2008/0115848 A1 5/2008 Bruck et al.
2008/0257350 A1* 10/2008 Huang ..... A61M 16/205 128/205.13
2008/0295568 A1* 12/2008 Nanaji ..... B67D 7/085 73/1.34
2009/0164050 A1 6/2009 Ahmad et al.
2010/0147394 A1 6/2010 Trnka et al.
2011/0105012 A1 5/2011 Niederhauser et al.
2011/0114304 A1 5/2011 Keller
2011/0162742 A1 7/2011 Ulens et al.
2012/0141303 A1 6/2012 Caldwell et al.
2013/0068313 A1 3/2013 George et al.
2013/0113402 A1 5/2013 Grabinger et al.
2013/0199627 A1 8/2013 Gilbert
2014/0034145 A1 2/2014 Burt
2014/0067135 A1 3/2014 Lehnert et al.
2014/0083159 A1* 3/2014 Nagai ..... G05D 7/00 73/1.34
2014/0083673 A1 3/2014 Thuillard et al.
2014/0097367 A1 4/2014 Burt
2014/0261714 A1 9/2014 Burt
2014/0277764 A1 9/2014 Burt
2015/0057816 A1 2/2015 Schick et al.
2015/0088321 A1 3/2015 Schmidt et al.
2015/0176931 A1* 6/2015 Aeberhard ..... F24F 11/83 165/200
2015/0277447 A1 10/2015 Schmidt
2015/0331430 A1* 11/2015 Yasuda ..... G05D 16/2006 137/485
2016/0054741 A1 2/2016 Thuillard et al.
2016/0139608 A1 5/2016 Eickhoff
2016/0246306 A1 8/2016 Giubertoni
2017/0029256 A1 2/2017 Das et al.
2017/0060106 A1* 3/2017 Bellido-Gonzalez ..... G05B 13/041
2017/0167912 A1* 6/2017 Okano ..... G01F 1/68
2017/0227134 A1 8/2017 Tuineag
2018/0188101 A1* 7/2018 Weindl ..... G01F 25/14
2021/0018214 A1* 1/2021 Peterson ..... F24F 11/84
2021/0405667 A1* 12/2021 Ishii ..... G05D 7/0623

FOREIGN PATENT DOCUMENTS

CN 1837996 A 9/2006
CN 1862421 A 11/2006
CN 200968437 Y 10/2007
CN 201011392 Y 1/2008
CN 201310667 Y 9/2009
CN 201330874 Y 10/2009
CN 201902628 U 7/2011
CN 202349311 U 7/2012
DE 22 16 464 A1 10/1973
DE 35 33 160 A1 3/1986
DE 41 40 408 A1 6/1993
DK 201400014 A1 1/2015
EP 2 395 289 A2 12/2011
EP 2 423 607 A2 2/2012
GB 2544799 A 5/2017
WO WO-98/25096 A1 6/1998
WO WO-2006/015220 A2 2/2006
WO WO-2012/065275 A1 5/2012
WO WO-2014/033496 A1 3/2014
WO WO-2017/050588 A1 3/2017
WO WO-2017/060031 A1 4/2017

OTHER PUBLICATIONS

Henz ( et al.), "Improving Campus Chilled Water Systems with Intelligent Control Valves: A Field Study," AEI ASCE, p. 102-111 (2013).

* cited by examiner

SYSTEMS AND METHODS FOR EXPEDITED FLOW SENSOR CALIBRATION

BACKGROUND

The present disclosure relates generally to building management systems and associated devices, and more particularly to systems and methods for expediting the calibration of a flow sensor in a pressure disturbance rejection valve assembly. A pressure disturbance rejection valve assembly includes an onboard electronic controller that is agnostic to system pressure fluctuations and instead controls a valve position based on a flow command received from an external control device and a flow rate measurement received from a flow rate sensor. Since the valve positions are determined by flow rate measurements, proper calibration of the flow rate sensor is crucial to proper functioning of the valve assembly.

Existing methods of calibrating a flow sensor for a pressure independent valve generally utilize a plug-in device that must be attached to the actuator board and manually calibrated by a technician. These methods are lengthy, cumbersome, and error-prone, not least of which because they fail to provide feedback at various steps in the calibration process. Improved methods of calibrating the flow sensor assembly would be useful.

SUMMARY

One implementation of the present disclosure is a method for calibrating a flow sensor in a heating, ventilation, or air conditioning (HVAC) system. The method includes receiving, at a controller, a request to enter a calibration mode. The method further includes in response to receiving the request, automatically commanding a flow control device to achieve a target flow rate, the flow control device operable by the controller to adjust a flow rate of a fluid through a fluid conduit. The method further includes generating, by the controller, calibration data for the flow sensor using a reference flow value of the flow rate when the flow control device has achieved the target flow rate and a corresponding flow measurement from the flow sensor.

In some embodiments, the method further includes operating the flow control device using one or more additional flow measurements from the flow sensor and the calibration data.

In some embodiments, automatically commanding the flow control device to achieve the target flow rate includes commanding the flow control device to achieve a flow rate measurable by the flow sensor.

In some embodiments, the method further includes obtaining the reference flow value from a pre-calibrated sensor positioned to measure the flow rate of the fluid through the fluid conduit when the flow control device has achieved the target flow rate.

In some embodiments, automatically commanding the flow control device to achieve the target flow rate comprises commanding the flow device to achieve a plurality of different target flow rates; wherein the reference flow value comprises a plurality of reference flow values corresponding to the plurality of different target flow rates.

In some embodiments, receiving the request to enter the calibration mode includes receiving the request from a user via a user interface.

In some embodiments, the method further includes receiving the reference flow value from a user via a user interface.

In some embodiments, generating the calibration data includes calculating an adjustment factor that transforms the flow measurement from the flow control sensor into the reference flow value.

Another implementation of the present disclosure is a flow sensor calibration system. The system includes a flow control device, a flow sensor, and a controller. The controller is configured to receive a request to enter a calibration mode. The controller is further configured to, in response to receiving the request, automatically command the flow control device achieve a target flow rate, the flow control device operable by the controller to adjust a flow rate of a fluid through a fluid conduit. The controller is further configured to generate, by the controller, calibration data for the flow sensor using a reference flow value of the flow rate when the flow control device has achieved the target flow rate and a corresponding flow measurement from the flow sensor.

In some embodiments, the controller is further configured to operate the flow control device using one or more additional flow measurements from the flow sensor and the calibration data.

In some embodiments, automatically commanding the flow control device achieve a target flow rate includes commanding the flow control device to achieve a maximum flow rate measurable by the flow sensor.

In some embodiments, the controller is further configured to obtain the reference flow value from a pre-calibrated sensor positioned to measure the flow rate of the fluid through the fluid conduit when the flow control device has achieved the target flow rate.

In some embodiments, receiving the request to enter the calibration mode includes receiving the request from a user via a user interface.

In some embodiments, the controller is further configured to receive the reference flow value from a user via a user interface.

In some embodiments, generating the calibration data includes calculating an adjustment factor that transforms the flow measurement from the flow control sensor into the reference flow value.

Another implementation of the present disclosure is a flow controller that includes a memory storing instructions that, when executed by a processor, cause the processor to receive a request to enter a calibration mode. The processor is further instructed to, in response to receiving the request, automatically command a flow control device to move into a predetermined position, the flow control device operable by the flow controller to adjust a flow rate of a fluid through a fluid conduit. The processor is further instructed to generate, by the flow controller, calibration data for the flow sensor using a reference flow value of the flow rate when the flow control device is at the predetermined position and a corresponding flow measurement from the flow sensor.

In some embodiments, the instructions cause the processor to operate the flow control device using one or more additional flow measurements from the flow sensor and the calibration data.

In some embodiments, automatically commanding the flow control device to move into the predetermined position includes commanding the flow control device to move into a maximum flow position.

In some embodiments, the instructions cause the processor to obtain the reference flow value from a pre-calibrated sensor positioned to measure the flow rate of the fluid through the fluid conduit when the flow control device is at the predetermined position.

In some embodiments, receiving the request to enter calibration mode includes receiving the request from a user via a user interface.

In some embodiments, the instructions cause the processor to receive the reference flow value from a user via a user interface.

In some embodiments, automatically commanding the flow control device to move into the predetermined position includes commanding the flow device to move into a plurality of different positions wherein the reference flow value comprises a plurality of reference flow values corresponding to the plurality of different positions.

DETAILED DESCRIPTION

Overview

Referring generally to the FIGURES, a control system in a building is shown. Buildings may include HVAC systems that can be configured to monitor and control temperature within a building zone by means of a HVAC waterside subsystem. These waterside subsystems may include coils that receive a fluid (e.g., water) via piping to control the temperature of a building zone.

The flow rate of water entering the coil may be monitored with flow sensors. To minimize the issue of flow sensor inaccuracy, a method to automate the calibration of the flow sensors is shown. This method includes incorporating an externally-calibrated source (e.g., external flow sensor) that has been externally-calibrated to serve as a reference flow measurement to recalibrate the original flow transitioning a typically manual process into a more automated process. The disclosed automatic flow calibration process has the ability to cut more than half of the calibration time while drastically reducing the risk of incorrect operation.

Building Management System and HVAC System

Figure 1:
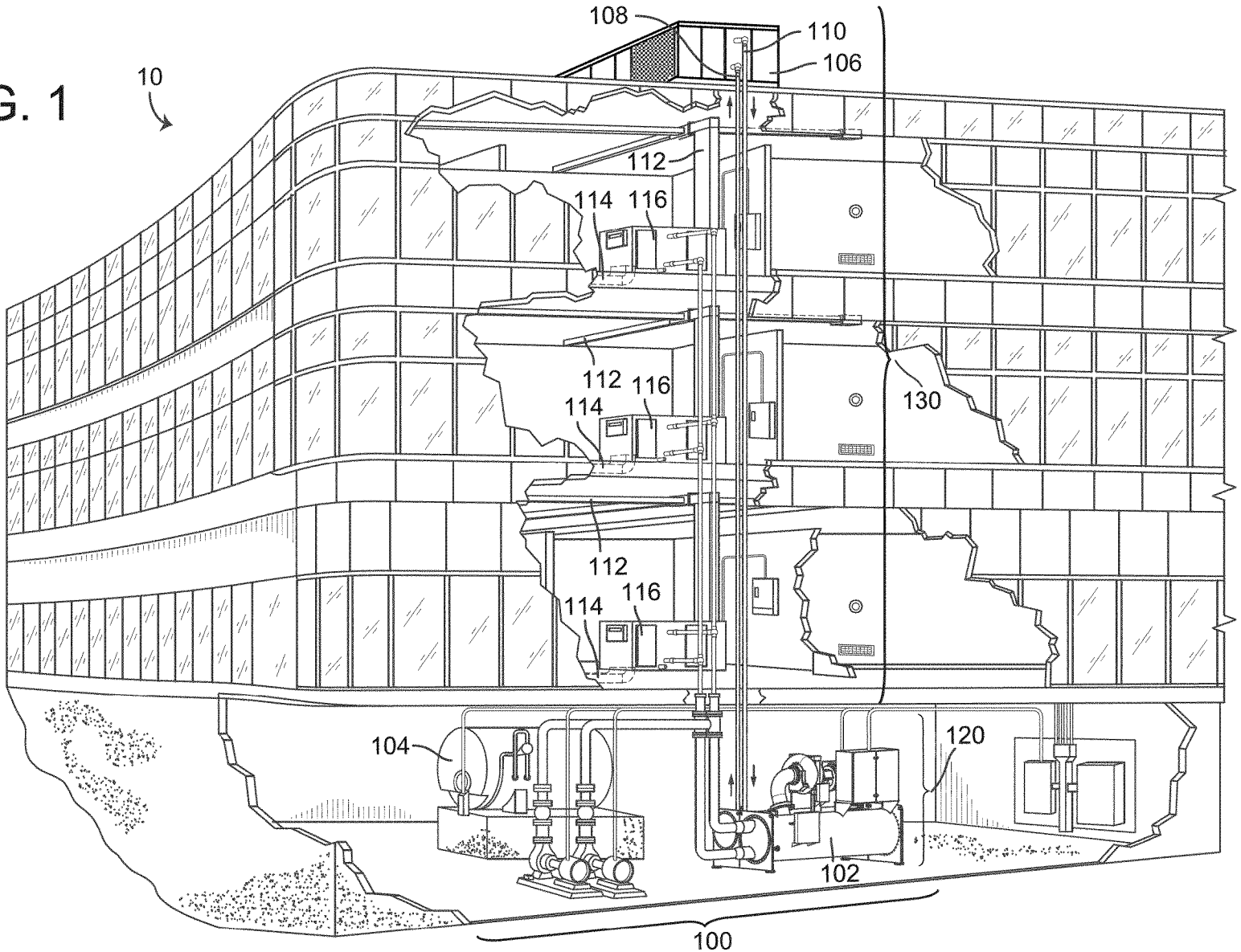
FIG. 1 is a drawing of a building equipped with a heating, ventilation, or air conditioning (HVAC) system, according to an exemplary embodiment.

Referring now to FIG. 1, a perspective view of a building 10 is shown. Building 10 is served by a building management system (BMS). A BMS is, in general, a system of devices configured to control, monitor, and manage equipment in or around a building or building area. A BMS can include, for example, a HVAC system, a security system, a lighting system, a fire alerting system, any other system that is capable of managing building functions or devices, or any combination thereof.

The BMS that serves building 10 includes an HVAC system 100. HVAC system 100 may include a plurality of HVAC devices (e.g., heaters, chillers, air handling units, pumps, fans, thermal energy storage, etc.) configured to provide heating, cooling, ventilation, or other services for building 10. For example, HVAC system 100 is shown to include a waterside system 120 and an airside system 130. Waterside system 120 may provide a heated or chilled fluid to an air handling unit of airside system 130. Airside system 130 may use the heated or chilled fluid to heat or cool an airflow provided to building 10. In some embodiments, waterside system 120 is replaced with a central energy plant such as central plant 200, described with reference to FIG. 2.

Still referring to FIG. 1, HVAC system 100 is shown to include a chiller 102, a boiler 104, and a rooftop air handling unit (AHU) 106. Waterside system 120 may use boiler 104 and chiller 102 to heat or cool a working fluid (e.g., water, glycol, etc.) and may circulate the working fluid to AHU 106. In various embodiments, the HVAC devices of waterside system 120 may be located in or around building 10 (as shown in FIG. 1) or at an offsite location such as a central plant (e.g., a chiller plant, a steam plant, a heat plant, etc.). The working fluid may be heated in boiler 104 or cooled in chiller 102, depending on whether heating or cooling is required in building 10. Boiler 104 may add heat to the circulated fluid, for example, by burning a combustible material (e.g., natural gas) or using an electric heating element. Chiller 102 may place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 may be transported to AHU 106 via piping 108.

AHU 106 may place the working fluid in a heat exchange relationship with an airflow passing through AHU 106 (e.g., via one or more stages of cooling coils and/or heating coils). The airflow may be, for example, outside air, return air from within building 10, or a combination of both. AHU 106 may transfer heat between the airflow and the working fluid to provide heating or cooling for the airflow. For example, AHU 106 may include one or more fans or blowers configured to pass the airflow over or through a heat exchanger containing the working fluid. The working fluid may then return to chiller 102 or boiler 104 via piping 110.

Airside system 130 may deliver the airflow supplied by AHU 106 (i.e., the supply airflow) to building 10 via air supply ducts 112 and may provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 may include dampers or other flow control elements that can be operated to control an amount of the supply airflow provided to individual zones of building 10. In other embodiments, airside system 130 delivers the supply airflow into one or more zones of building 10 (e.g., via air supply ducts 112) without using intermediate VAV units 116 or other flow control elements. AHU 106 may include various sensors (e.g., temperature sensors, pressure sensors, etc.) configured to measure attributes of the supply airflow. AHU 106 may receive input from sensors located within AHU 106 and/or within the building zone and may adjust the flow rate, temperature, or other attributes of the supply airflow through AHU 106 to achieve setpoint conditions for the building zone.

Figure 2:
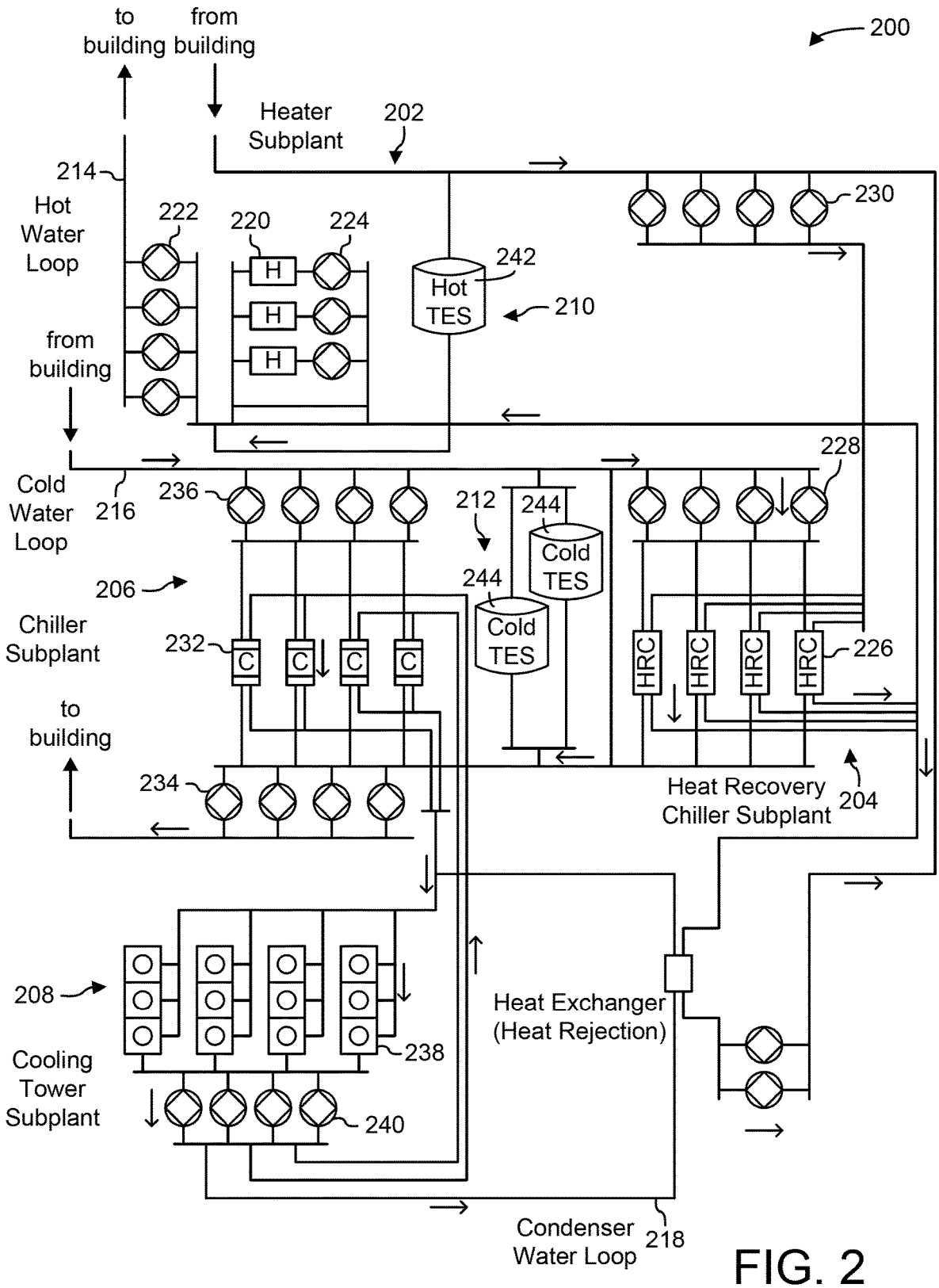
FIG. 2 is a schematic of a waterside system which can be used as part of the HVAC system of FIG. 1, according to some embodiments.

Referring now to FIG. 2, a block diagram of a central plant 200 is shown, according to an exemplary embodiment. In brief overview, central plant 200 may include various types of equipment configured to serve the thermal energy loads of a building or campus (i.e., a system of buildings). For example, central plant 200 may include heaters, chillers, heat recovery chillers, cooling towers, or other types of equipment configured to serve the heating and/or cooling loads of a building or campus. Central plant 200 may consume resources from a utility (e.g., electricity, water, natural gas, etc.) to heat or cool a working fluid that is circulated to one or more buildings or stored for later use (e.g., in thermal energy storage tanks) to provide heating or cooling for the buildings. In various embodiments, central plant 200 may supplement or replace waterside system 120 in building 10 or may be implemented separate from building 10 (e.g., at an offsite location).

Central plant 200 is shown to include a plurality of subplants 202-212 including a heater subplant 202, a heat recovery chiller subplant 204, a chiller subplant 206, a cooling tower subplant 208, a hot thermal energy storage (TES) subplant 210, and a cold thermal energy storage (TES) subplant 212. Subplants 202-212 consume resources from utilities to serve the thermal energy loads (e.g., hot water, cold water, heating, cooling, etc.) of a building or campus. For example, heater subplant 202 may be configured to heat water in a hot water loop 214 that circulates the hot water between heater subplant 202 and building 10. Chiller subplant 206 may be configured to chill water in a cold water loop 216 that circulates the cold water between chiller subplant 206 and building 10. Heat recovery chiller subplant 204 may be configured to transfer heat from cold water loop 216 to hot water loop 214 to provide additional heating for the hot water and additional cooling for the cold water. Condenser water loop 218 may absorb heat from the cold water in chiller subplant 206 and reject the absorbed heat in cooling tower subplant 208 or transfer the absorbed heat to hot water loop 214. Hot TES subplant 210 and cold TES subplant 212 may store hot and cold thermal energy, respectively, for subsequent use.

Hot water loop 214 and cold water loop 216 may deliver the heated and/or chilled water to air handlers located on the rooftop of building 10 (e.g., AHU 106) or to individual floors or zones of building 10 (e.g., VAV units 116). The air handlers push air past heat exchangers (e.g., heating coils or cooling coils) through which the water flows to provide heating or cooling for the air. The heated or cooled air may be delivered to individual zones of building 10 to serve the thermal energy loads of building 10. The water then returns to subplants 202-212 to receive further heating or cooling.

Although subplants 202-212 are shown and described as heating and cooling water for circulation to a building, it is understood that any other type of working fluid (e.g., glycol, $CO_2$, etc.) may be used in place of or in addition to water to serve the thermal energy loads. In other embodiments, subplants 202-212 may provide heating and/or cooling directly to the building or campus without requiring an intermediate heat transfer fluid. These and other variations to central plant 200 are within the teachings of the present invention.

Each of subplants 202-212 may include a variety of equipment configured to facilitate the functions of the subplant. For example, heater subplant 202 is shown to include a plurality of heating elements 220 (e.g., boilers, electric heaters, etc.) configured to add heat to the hot water in hot water loop 214. Heater subplant 202 is also shown to include several pumps 222 and 224 configured to circulate the hot water in hot water loop 214 and to control the flow rate of the hot water through individual heating elements 220. Chiller subplant 206 is shown to include a plurality of chillers 232 configured to remove heat from the cold water in cold water loop 216. Chiller subplant 206 is also shown to include several pumps 234 and 236 configured to circulate the cold water in cold water loop 216 and to control the flow rate of the cold water through individual chillers 232.

Heat recovery chiller subplant 204 is shown to include a plurality of heat recovery heat exchangers 226 (e.g., refrigeration circuits) configured to transfer heat from cold water loop 216 to hot water loop 214. Heat recovery chiller subplant 204 is also shown to include several pumps 228 and 230 configured to circulate the hot water and/or cold water through heat recovery heat exchangers 226 and to control the flow rate of the water through individual heat recovery heat exchangers 226. Cooling tower subplant 208 is shown to include a plurality of cooling towers 238 configured to remove heat from the condenser water in condenser water loop 218. Cooling tower subplant 208 is also shown to include several pumps 240 configured to circulate the condenser water in condenser water loop 218 and to control the flow rate of the condenser water through individual cooling towers 238.

Hot TES subplant 210 is shown to include a hot TES tank 242 configured to store the hot water for later use. Hot TES subplant 210 may also include one or more pumps or valves configured to control the flow rate of the hot water into or out of hot TES tank 242. Cold TES subplant 212 is shown to include cold TES tanks 244 configured to store the cold water for later use. Cold TES subplant 212 may also include one or more pumps or valves configured to control the flow rate of the cold water into or out of cold TES tanks 244.

In some embodiments, one or more of the pumps in central plant 200 (e.g., pumps 222, 224, 228, 230, 234, 236, and/or 240) or pipelines in central plant 200 include an isolation valve associated therewith. Isolation valves may be integrated with the pumps or positioned upstream or downstream of the pumps to control the fluid flows in central plant 200. In various embodiments, central plant 200 may include more, fewer, or different types of devices and/or subplants based on the particular configuration of central plant 200 and the types of loads served by central plant 200.

Figure 3:
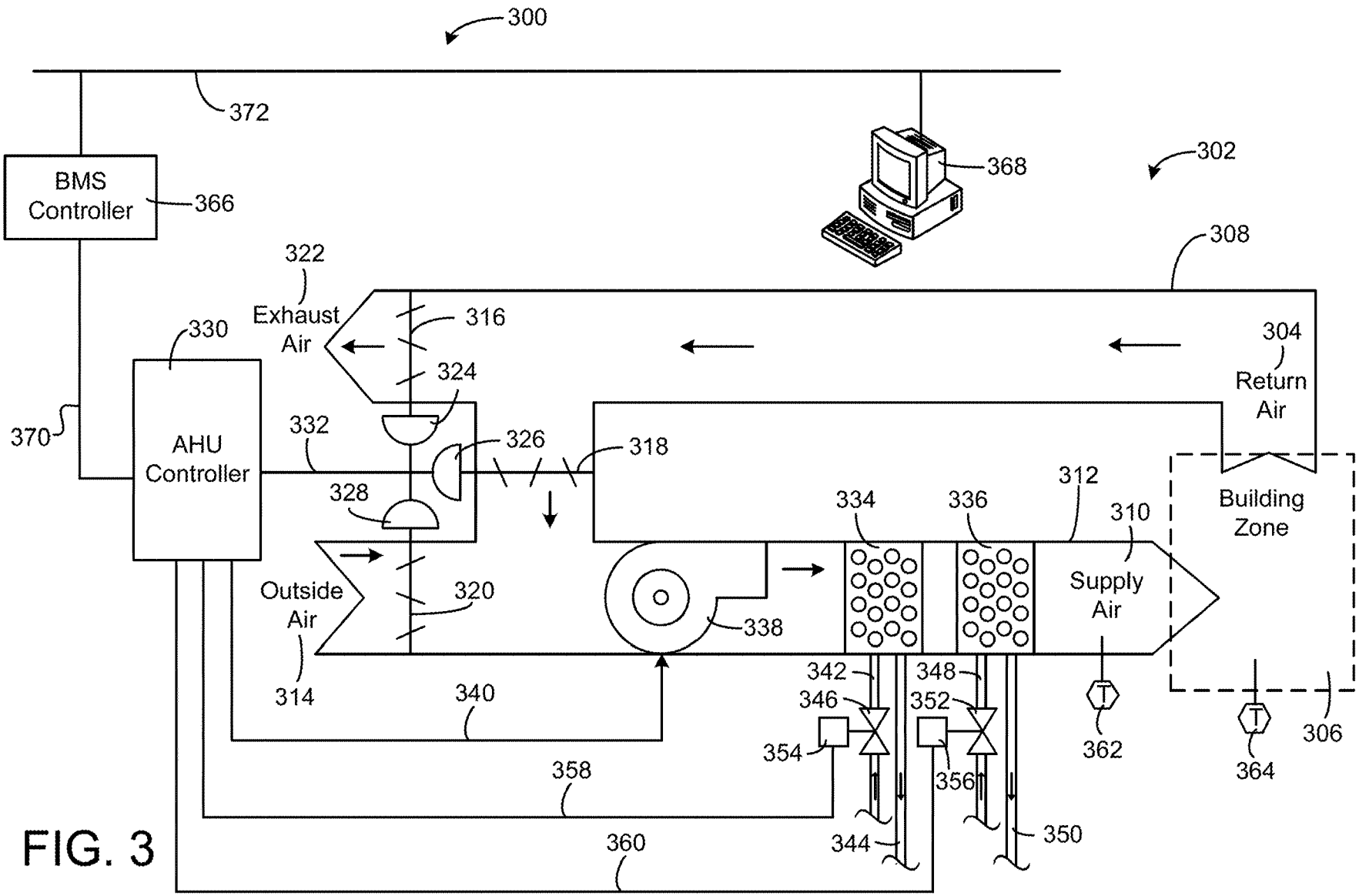
FIG. 3 is a block diagram of an airside system which can be used as part of the HVAC system of FIG. 1, according to some embodiments.

Referring now to FIG. 3, a block diagram of an airside system 300 is shown, according to an example embodiment. In various embodiments, airside system 300 can supplement or replace airside system 130 in HVAC system 100 or can be implemented separate from HVAC system 100. When implemented in HVAC system 100, airside system 300 can include a subset of the HVAC devices in HVAC system 100 (e.g., AHU 106, VAV units 116, duct 112, duct 114, fans, dampers, etc.) and can be located in or around building 10. Airside system 300 can operate to heat or cool an airflow provided to building 10 using a heated or chilled fluid provided by waterside system 200.

In FIG. 3, airside system 300 is shown to include an economizer-type air handling unit (AHU) 302. Economizer-type AHUs vary the amount of outside air and return air used by the air handling unit for heating or cooling. For example, AHU 302 can receive return air 304 from building zone 306 via return air duct 308 and can deliver supply air 310 to building zone 306 via supply air duct 312. In some embodiments, AHU 302 is a rooftop unit located on the roof of building 10 (e.g., AHU 106 as shown in FIG. 1) or otherwise positioned to receive both return air 304 and outside air 314. AHU 302 can be configured to operate exhaust air damper 316, mixing damper 318, and outside air damper 320 to control an amount of outside air 314 and return air 304 that combine to form supply air 310. Any return air 304 that does not pass through mixing damper 318 can be exhausted from AHU 302 through exhaust damper 316 as exhaust air 322.

Each of dampers 316-320 can be operated by an actuator. For example, exhaust air damper 316 can be operated by actuator 324, mixing damper 318 can be operated by actuator 326, and outside air damper 320 can be operated by actuator 328. Actuators 324-328 can communicate with an AHU controller 330 via a communications link 332. Actuators 324-328 can receive control signals from AHU controller 330 and can provide feedback signals to AHU controller 330. Feedback signals can include, for example, an indication of a current actuator or damper position, an amount of torque or force exerted by the actuator, diagnostic information (e.g., results of diagnostic tests performed by actuators 324-328), status information, commissioning information, configuration settings, calibration data, and/or other types of information or data that can be collected, stored, or used by actuators 324-328. AHU controller 330 can be an economizer controller configured to use one or more control algorithms (e.g., state-based algorithms, extremum seeking control (ESC) algorithms, proportional-integral (PI) control algorithms, proportional-integral-derivative (PID) control algorithms, model predictive control (MPC) algorithms, feedback control algorithms, etc.) to control actuators 324-328.

Still referring to FIG. 3, AHU 302 is shown to include a cooling coil 334, a heating coil 336, and a fan 338 positioned within supply air duct 312. Fan 338 can be configured to force supply air 310 through cooling coil 334 and/or heating coil 336 and provide supply air 310 to building zone 306. AHU controller 330 can communicate with fan 338 via communications link 340 to control a flow rate of supply air 310. In some embodiments, AHU controller 330 controls an amount of heating or cooling applied to supply air 310 by modulating a speed of fan 338.

Cooling coil 334 can receive a chilled fluid from waterside system 200 (e.g., from cold water loop 216) via piping 342 and can return the chilled fluid to waterside system 200 via piping 344. Valve 346 can be positioned along piping 342 or piping 344 to control a flow rate of the chilled fluid through cooling coil 334. In some embodiments, cooling coil 334 includes multiple stages of cooling coils that can be independently activated and deactivated (e.g., by AHU controller 330, by BMS controller 366, etc.) to modulate an amount of cooling applied to supply air 310.

Heating coil 336 can receive a heated fluid from waterside system 200 (e.g., from hot water loop 214) via piping 348 and can return the heated fluid to waterside system 200 via piping 350. Valve 352 can be positioned along piping 348 or piping 350 to control a flow rate of the heated fluid through heating coil 336. In some embodiments, heating coil 336 includes multiple stages of heating coils that can be independently activated and deactivated (e.g., by AHU controller 330, by BMS controller 366, etc.) to modulate an amount of heating applied to supply air 310.

Each of valves 346 and 352 can be controlled by an actuator. For example, valve 346 can be controlled by actuator 354 and valve 352 can be controlled by actuator 356. Actuators 354-356 can communicate with AHU controller 330 via communications links 358-360. Actuators 354-356 can receive control signals from AHU controller 330 and can provide feedback signals to controller 330. In some embodiments, AHU controller 330 receives a measurement of the supply air temperature from a temperature sensor 362 positioned in supply air duct 312 (e.g., downstream of cooling coil 334 and/or heating coil 336). AHU controller 330 can also receive a measurement of the temperature of building zone 306 from a temperature sensor 364 located in building zone 306.

In some embodiments, AHU controller 330 operates valves 346 and 352 via actuators 354-356 to modulate an amount of heating or cooling provided to supply air 310 (e.g., to achieve a setpoint temperature for supply air 310 or to maintain the temperature of supply air 310 within a setpoint temperature range). The positions of valves 346 and 352 affect the amount of heating or cooling provided to supply air 310 by cooling coil 334 or heating coil 336 and may correlate with the amount of energy consumed to achieve a desired supply air temperature. AHU controller 330 can control the temperature of supply air 310 and/or building zone 306 by activating or deactivating coils 334-336, adjusting a speed of fan 338, or a combination of both.

Still referring to FIG. 3, airside system 300 is shown to include a building management system (BMS) controller 366 and a client device 368. BMS controller 366 can include one or more computer systems (e.g., servers, supervisory controllers, subsystem controllers, etc.) that serve as system level controllers, application or data servers, head nodes, or master controllers for airside system 300, waterside system 200, HVAC system 100, and/or other controllable systems that serve building 10. BMS controller 366 can communicate with multiple downstream building systems or subsystems (e.g., HVAC system 100, a security system, a lighting system, waterside system 200, etc.) via a communications link 370 according to like or disparate protocols (e.g., LON, BACnet, etc.). In various embodiments, AHU controller 330 and BMS controller 366 can be separate (as shown in FIG. 3) or integrated. In an integrated implementation, AHU controller 330 can be a software module configured for execution by a processor of BMS controller 366.

In some embodiments, AHU controller 330 receives information from BMS controller 366 (e.g., commands, setpoints, operating boundaries, etc.) and provides information to BMS controller 366 (e.g., temperature measurements, valve or actuator positions, operating statuses, diagnostics, etc.). For example, AHU controller 330 can provide BMS controller 366 with temperature measurements from temperature sensors 362 and 364, equipment on/off states, equipment operating capacities, and/or any other information that can be used by BMS controller 366 to monitor or control a variable state or condition within building zone 306.

Client device 368 can include one or more human-machine interfaces or client interfaces (e.g., graphical user interfaces, reporting interfaces, text-based computer interfaces, client-facing web services, web servers that provide pages to web clients, etc.) for controlling, viewing, or otherwise interacting with HVAC system 100, its subsystems, and/or devices. Client device 368 can be a computer workstation, a client terminal, a remote or local interface, or any other type of user interface device. Client device 368 can be a stationary terminal or a mobile device. For example, client device 368 can be a desktop computer, a computer server with a user interface, a laptop computer, a tablet, a smartphone, a PDA, or any other type of mobile or non-mobile device. Client device 368 can communicate with BMS controller 366 and/or AHU controller 330 via communications link 372.

Figure 4:
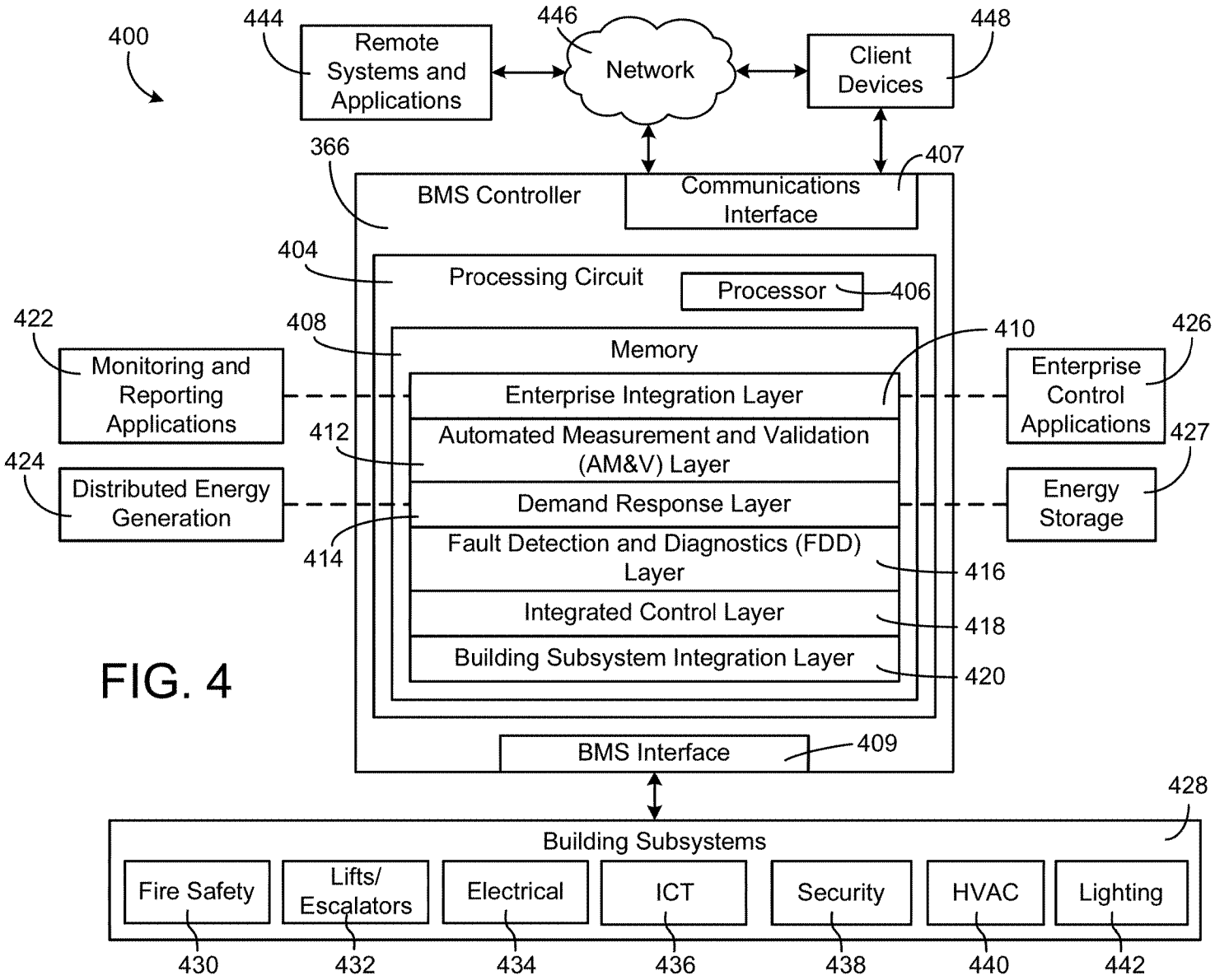
FIG. 4 is a block diagram of a building management system (BMS) which can be used in the building of FIG. 1, according to some embodiments.

Referring now to FIG. 4, a block diagram of a building management system (BMS) 400 is shown, according to an example embodiment. BMS 400 can be implemented in building 10 to automatically monitor and control various building functions. BMS 400 is shown to include BMS controller 366 and a plurality of building subsystems 428. Building subsystems 428 are shown to include a building electrical subsystem 434, an information communication technology (ICT) subsystem 436, a security subsystem 438, a HVAC subsystem 440, a lighting subsystem 442, a lift/escalators subsystem 432, and a fire safety subsystem 430. In various embodiments, building subsystems 428 can include fewer, additional, or alternative subsystems. For example, building subsystems 428 can also or alternatively include a refrigeration subsystem, an advertising or signage subsystem, a cooking subsystem, a vending subsystem, a printer or copy service subsystem, or any other type of building subsystem that uses controllable equipment and/or sensors to monitor or control building 10. In some embodiments, building subsystems 428 include waterside system 200 and/or airside system 300, as described with reference to FIGS. 2 and 3.

Each of building subsystems 428 can include any number of devices, controllers, and connections for completing its individual functions and control activities. HVAC subsystem 440 can include many of the same components as HVAC system 100, as described with reference to FIGS. 1-3. For example, HVAC subsystem 440 can include a chiller, a boiler, any number of air handling units, economizers, field controllers, supervisory controllers, actuators, temperature sensors, and other devices for controlling the temperature, humidity, airflow, or other variable conditions within building 10. Lighting subsystem 442 can include any number of light fixtures, ballasts, lighting sensors, dimmers, or other devices configured to controllably adjust the amount of light provided to a building space. Security subsystem 438 can include occupancy sensors, video surveillance cameras, digital video recorders, video processing servers, intrusion detection devices, access control devices (e.g., card access, etc.) and servers, or other security-related devices.

Still referring to FIG. 4, BMS controller 366 is shown to include a communications interface 407 and a BMS interface 409. Interface 407 can facilitate communications between BMS controller 366 and external applications (e.g., monitoring and reporting applications 422, enterprise control applications 426, remote systems and applications 444, applications residing on client devices 448, etc.) for allowing user control, monitoring, and adjustment to BMS controller 366 and/or subsystems 428. Interface 407 can also facilitate communications between BMS controller 366 and client devices 448. BMS interface 409 can facilitate communications between BMS controller 366 and building subsystems 428 (e.g., HVAC, lighting security, lifts, power distribution, business, etc.).

Interfaces 407, 409 can be or include wired or wireless communications interfaces (e.g., jacks, antennas, transmitters, receivers, transceivers, wire terminals, etc.) for conducting data communications with building subsystems 428 or other external systems or devices. In various embodiments, communications via interfaces 407, 409 can be direct (e.g., local wired or wireless communications) or via a communications network 446 (e.g., a WAN, the Internet, a cellular network, etc.). For example, interfaces 407, 409 can include an Ethernet card and port for sending and receiving data via an Ethernet-based communications link or network. In another example, interfaces 407, 409 can include a Wi-Fi transceiver for communicating via a wireless communications network. In another example, one or both of interfaces 407, 409 can include cellular or mobile phone communications transceivers. In one embodiment, communications interface 407 is a power line communications interface and BMS interface 409 is an Ethernet interface. In other embodiments, both communications interface 407 and BMS interface 409 are Ethernet interfaces or are the same Ethernet interface.

Still referring to FIG. 4, BMS controller 366 is shown to include a processing circuit 404 including a processor 406 and memory 408. Processing circuit 404 can be communicably connected to BMS interface 409 and/or communications interface 407 such that processing circuit 404 and the various components thereof can send and receive data via interfaces 407, 409. Processor 406 can be implemented as a general purpose processor, an application specific integrated circuit (ASIC), one or more field programmable gate arrays (FPGAs), a group of processing components, or other suitable electronic processing components.

Memory 408 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 408 can be or include volatile memory or non-volatile memory. Memory 408 can include database components, object code components, script components, or any other type of information structure for supporting the various activities and information structures described in the present application. According to an example embodiment, memory 408 is communicably connected to processor 406 via processing circuit 404 and includes computer code for executing (e.g., by processing circuit 404 and/or processor 406) one or more processes described herein.

In some embodiments, BMS controller 366 is implemented within a single computer (e.g., one server, one housing, etc.). In various other embodiments BMS controller 366 can be distributed across multiple servers or computers (e.g., that can exist in distributed locations). Further, while FIG. 4 shows applications 422 and 426 as existing outside of BMS controller 366, in some embodiments, applications 422 and 426 can be hosted within BMS controller 366 (e.g., within memory 408).

Still referring to FIG. 4, memory 408 is shown to include an enterprise integration layer 410, an automated measurement and validation (AM&V) layer 412, a demand response (DR) layer 414, a fault detection and diagnostics (FDD)

layer 416, an integrated control layer 418, and a building subsystem integration later 420. Layers 410-420 can be configured to receive inputs from building subsystems 428 and other data sources, determine optimal control actions for building subsystems 428 based on the inputs, generate control signals based on the optimal control actions, and provide the generated control signals to building subsystems 428. The following paragraphs describe some of the general functions performed by each of layers 410-420 in BMS 400.

Enterprise integration layer 410 can be configured to serve clients or local applications with information and services to support a variety of enterprise-level applications. For example, enterprise control applications 426 can be configured to provide subsystem-spanning control to a graphical user interface (GUI) or to any number of enterprise-level business applications (e.g., accounting systems, user identification systems, etc.). Enterprise control applications 426 can also or alternatively be configured to provide configuration GUIs for configuring BMS controller 366. In yet other embodiments, enterprise control applications 426 can work with layers 410-420 to optimize building performance (e.g., efficiency, energy use, comfort, or safety) based on inputs received at interface 407 and/or BMS interface 409.

Building subsystem integration layer 420 can be configured to manage communications between BMS controller 366 and building subsystems 428. For example, building subsystem integration layer 420 can receive sensor data and input signals from building subsystems 428 and provide output data and control signals to building subsystems 428. Building subsystem integration layer 420 can also be configured to manage communications between building subsystems 428. Building subsystem integration layer 420 translate communications (e.g., sensor data, input signals, output signals, etc.) across a plurality of multi-vendor/multi-protocol systems.

Demand response layer 414 can be configured to optimize resource usage (e.g., electricity use, natural gas use, water use, etc.) and/or the monetary cost of such resource usage in response to satisfy the demand of building 10. The optimization can be based on time-of-use prices, curtailment signals, energy availability, or other data received from utility providers, distributed energy generation systems 424, from energy storage 427 (e.g., hot TES 242, cold TES 244, etc.), or from other sources. Demand response layer 414 can receive inputs from other layers of BMS controller 366 (e.g., building subsystem integration layer 420, integrated control layer 418, etc.). The inputs received from other layers can include environmental or sensor inputs such as temperature, carbon dioxide levels, relative humidity levels, air quality sensor outputs, occupancy sensor outputs, room schedules, and the like. The inputs can also include inputs such as electrical use (e.g., expressed in kWh), thermal load measurements, pricing information, projected pricing, smoothed pricing, curtailment signals from utilities, and the like.

According to an example embodiment, demand response layer 414 includes control logic for responding to the data and signals it receives. These responses can include communicating with the control algorithms in integrated control layer 418, changing control strategies, changing setpoints, or activating/deactivating building equipment or subsystems in a controlled manner. Demand response layer 414 can also include control logic configured to determine when to utilize stored energy. For example, demand response layer 414 can determine to begin using energy from energy storage 427 just prior to the beginning of a peak use hour.

In some embodiments, demand response layer 414 includes a control module configured to actively initiate control actions (e.g., automatically changing setpoints) which minimize energy costs based on one or more inputs representative of or based on demand (e.g., price, a curtailment signal, a demand level, etc.). In some embodiments, demand response layer 414 uses equipment models to determine an optimal set of control actions. The equipment models can include, for example, thermodynamic models describing the inputs, outputs, and/or functions performed by various sets of building equipment. Equipment models can represent collections of building equipment (e.g., subplants, chiller arrays, etc.) or individual devices (e.g., individual chillers, heaters, pumps, etc.).

Demand response layer 414 can further include or draw upon one or more demand response policy definitions (e.g., databases, XML files, etc.). The policy definitions can be edited or adjusted by a user (e.g., via a graphical user interface) so that the control actions initiated in response to demand inputs can be tailored for the user's application, desired comfort level, particular building equipment, or based on other concerns. For example, the demand response policy definitions can specify which equipment can be turned on or off in response to particular demand inputs, how long a system or piece of equipment should be turned off, what setpoints can be changed, what the allowable set point adjustment range is, how long to hold a high demand setpoint before returning to a normally scheduled setpoint, how close to approach capacity limits, which equipment modes to utilize, the energy transfer rates (e.g., the maximum rate, an alarm rate, other rate boundary information, etc.) into and out of energy storage devices (e.g., thermal storage tanks, battery banks, etc.), and when to dispatch on-site generation of energy (e.g., via fuel cells, a motor generator set, etc.).

Integrated control layer 418 can be configured to use the data input or output of building subsystem integration layer 420 and/or demand response later 414 to make control decisions. Due to the subsystem integration provided by building subsystem integration layer 420, integrated control layer 418 can integrate control activities of the subsystems 428 such that the subsystems 428 behave as a single integrated supersystem. In an example embodiment, integrated control layer 418 includes control logic that uses inputs and outputs from a plurality of building subsystems to provide greater comfort and energy savings relative to the comfort and energy savings that separate subsystems could provide alone. For example, integrated control layer 418 can be configured to use an input from a first subsystem to make an energy-saving control decision for a second subsystem. Results of these decisions can be communicated back to building subsystem integration layer 420.

Integrated control layer 418 is shown to be logically below demand response layer 414. Integrated control layer 418 can be configured to enhance the effectiveness of demand response layer 414 by enabling building subsystems 428 and their respective control loops to be controlled in coordination with demand response layer 414. This configuration may advantageously reduce disruptive demand response behavior relative to conventional systems. For example, integrated control layer 418 can be configured to assure that a demand response-driven upward adjustment to the setpoint for chilled water temperature (or another component that directly or indirectly affects temperature) does not result in an increase in fan energy (or other energy used to cool a space) that would result in greater total building energy use than was saved at the chiller.

Integrated control layer 418 can be configured to provide feedback to demand response layer 414 so that demand response layer 414 checks that constraints (e.g., temperature, lighting levels, etc.) are properly maintained even while demanded load shedding is in progress. The constraints can also include setpoint or sensed boundaries relating to safety, equipment operating limits and performance, comfort, fire codes, electrical codes, energy codes, and the like. Integrated control layer 418 is also logically below fault detection and diagnostics layer 416 and automated measurement and validation layer 412. Integrated control layer 418 can be configured to provide calculated inputs (e.g., aggregations) to these higher levels based on outputs from more than one building subsystem.

Automated measurement and validation (AM&V) layer 412 can be configured to verify that control strategies commanded by integrated control layer 418 or demand response layer 414 are working properly (e.g., using data aggregated by AM&V layer 412, integrated control layer 418, building subsystem integration layer 420, FDD layer 416, or otherwise). The calculations made by AM&V layer 412 can be based on building system energy models and/or equipment models for individual BMS devices or subsystems. For example, AM&V layer 412 can compare a model-predicted output with an actual output from building subsystems 428 to determine an accuracy of the model.

Fault detection and diagnostics (FDD) layer 416 can be configured to provide on-going fault detection for building subsystems 428, building subsystem devices (i.e., building equipment), and control algorithms used by demand response layer 414 and integrated control layer 418. FDD layer 416 can receive data inputs from integrated control layer 418, directly from one or more building subsystems or devices, or from another data source. FDD layer 416 can automatically diagnose and respond to detected faults. The responses to detected or diagnosed faults can include providing an alert message to a user, a maintenance scheduling system, or a control algorithm configured to attempt to repair the fault or to work-around the fault.

FDD layer 416 can be configured to output a specific identification of the faulty component or cause of the fault (e.g., loose damper linkage) using detailed subsystem inputs available at building subsystem integration layer 420. In other example embodiments, FDD layer 416 is configured to provide "fault" events to integrated control layer 418 which executes control strategies and policies in response to the received fault events. According to an example embodiment, FDD layer 416 (or a policy executed by an integrated control engine or business rules engine) can shut-down systems or direct control activities around faulty devices or systems to reduce energy waste, extend equipment life, or assure proper control response.

FDD layer 416 can be configured to store or access a variety of different system data stores (or data points for live data). FDD layer 416 can use some content of the data stores to identify faults at the equipment level (e.g., specific chiller, specific AHU, specific terminal unit, etc.) and other content to identify faults at component or subsystem levels. For example, building subsystems 428 can generate temporal (i.e., time-series) data indicating the performance of BMS 400 and the various components thereof. The data generated by building subsystems 428 can include measured or calculated values that exhibit statistical characteristics and provide information about how the corresponding system or process (e.g., a temperature control process, a flow control process, etc.) is performing in terms of error from its setpoint. These processes can be examined by FDD layer 416 to expose when the system begins to degrade in performance and alert a user to repair the fault before it becomes more severe.

Feedback Control System for Valve and Actuator Assembly

Figure 5A:
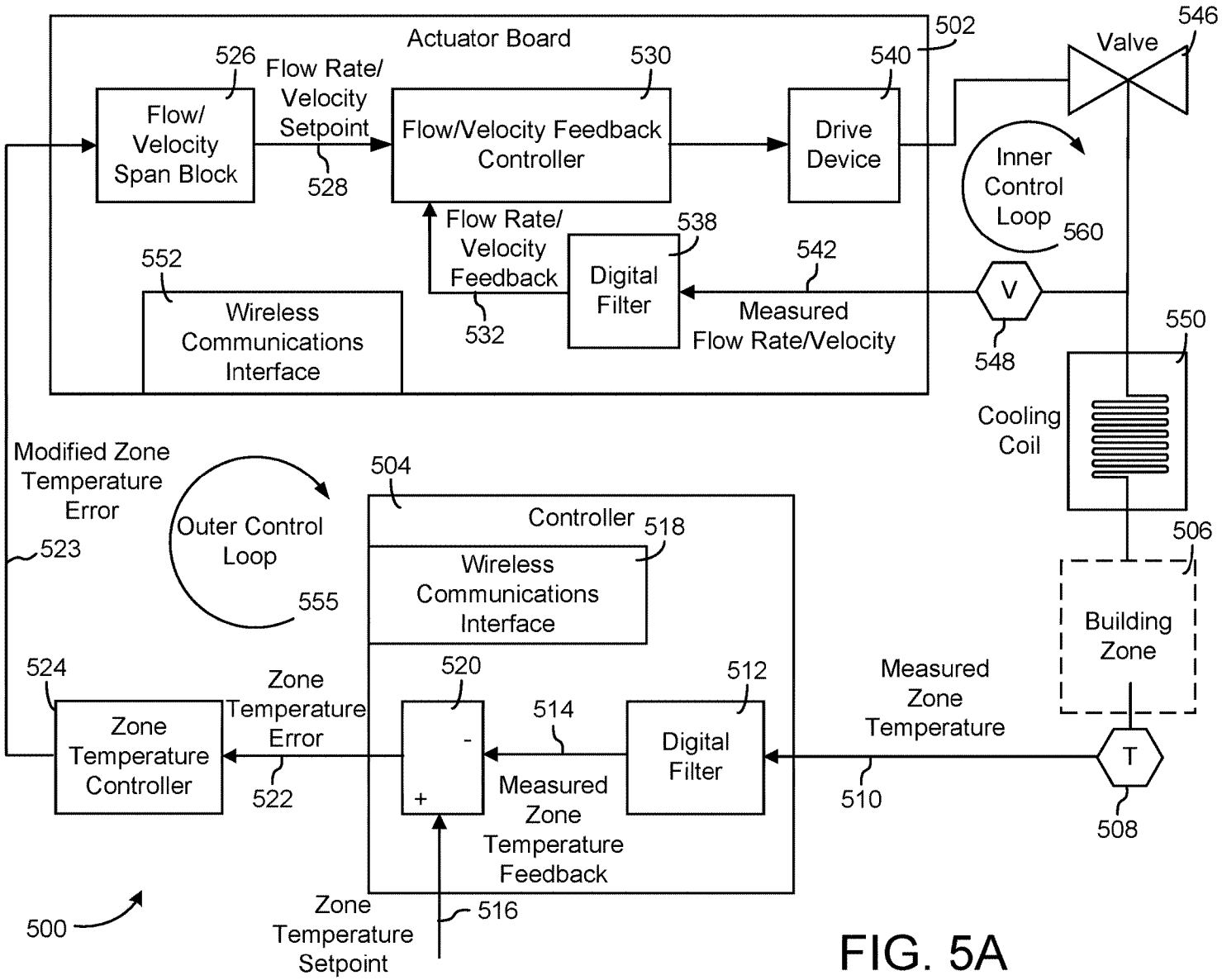
FIG. 5A is a block diagram of a feedback control system which can be used as part of the HVAC system of FIG. 1, according to some embodiments.
Figure 5B:
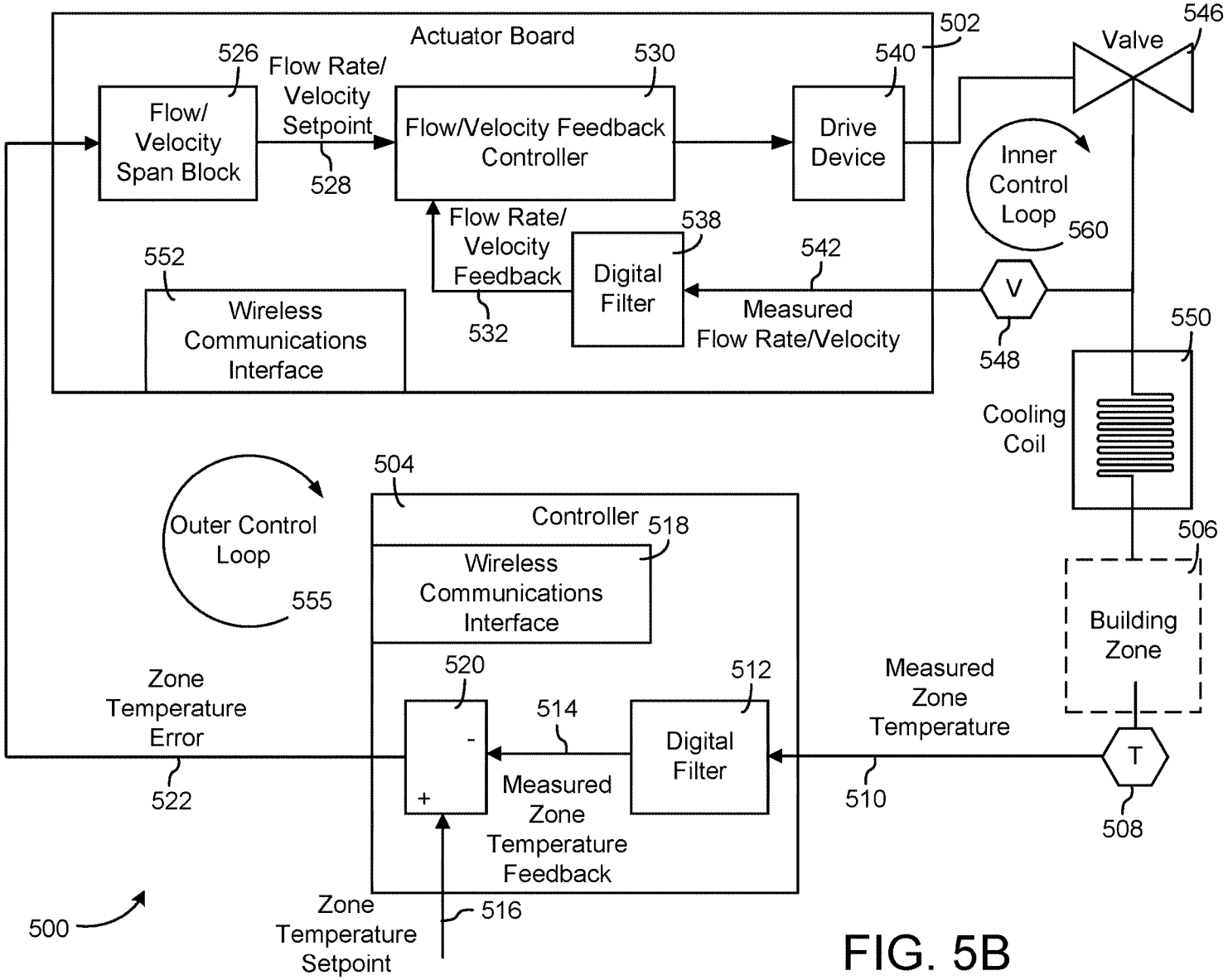
FIG. 5B is a block diagram of a feedback control system which can be used as part of the HVAC system of FIG. 1, according to some embodiments.
Figure 5C:
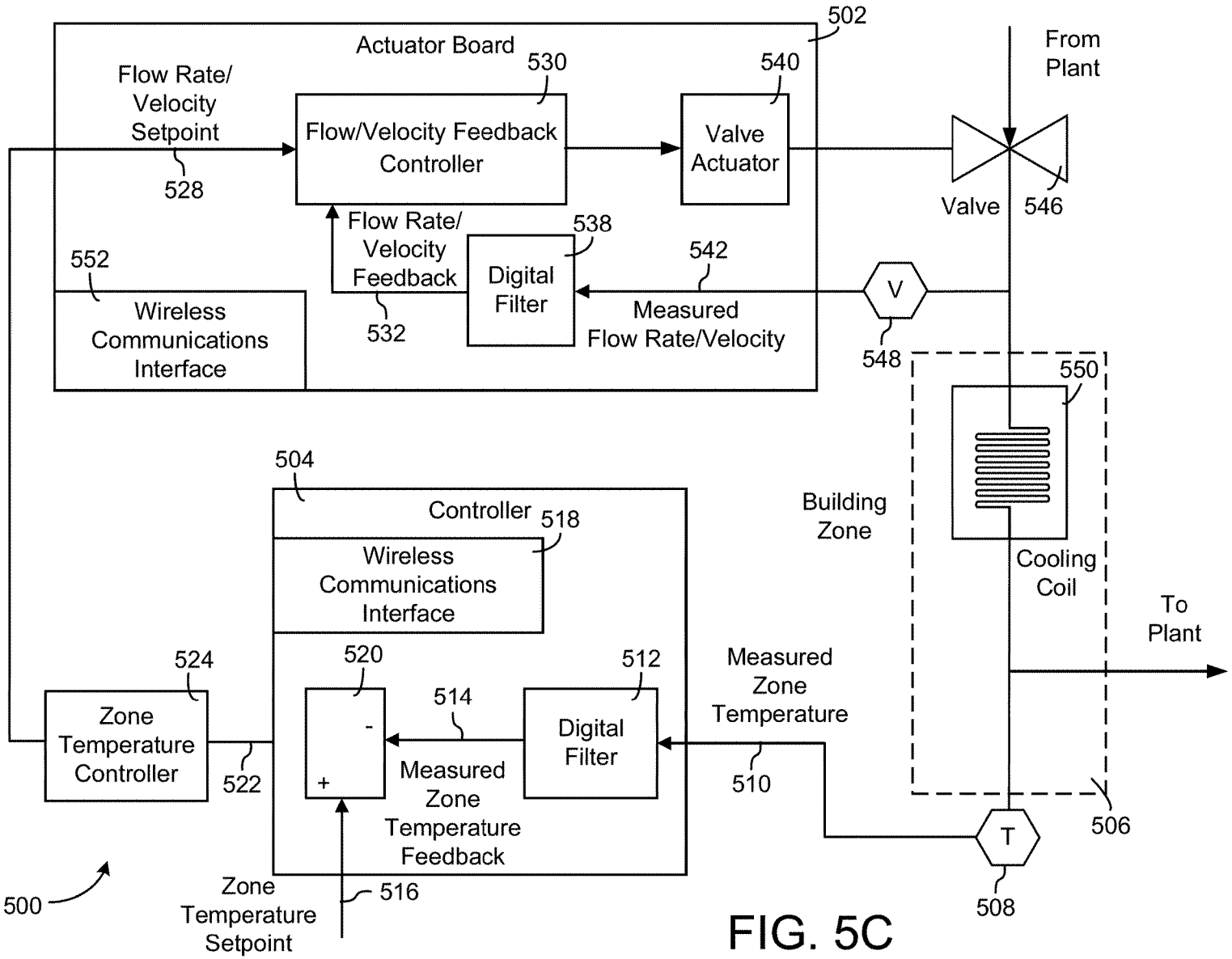
FIG. 5C is a block diagram of a feedback control system which can be used as part of the HVAC system of FIG. 1, according to some embodiments.

Turning now to FIGS. 5A-C, a block diagram of an actuator 502 within a feedback control system 500 is shown. In some embodiments, feedback control system 500 is a cascaded feedback control system. Referring now to FIG. 5A a primary controller (e.g., controller 504) receives zone temperature setpoint 516 and generates zone temperature error 522. Zone temperature controller 524 receives zone temperature error 522 and may generate a modified zone temperature error 523 that serves as the setpoint for a secondary controller (e.g., flow/velocity feedback controller 530). Zone temperature controller 524 may modify zone temperature error 522. Outer control loop 555 is shown to include zone temperature controller 524, actuator 502, and controller 504 in series with feedback from measured zone temperature 510. In some embodiments, outer control loop 555 includes an inner control loop 560 configured to modulate fluid flow from valve 546 based on feedback from flow sensor 548. In some embodiments, feedback control system 500 is a component or subsystem of HVAC system 100, waterside system 200, airside system 300, or BMS 400, as described with reference to FIGS. 1-4.

Feedback control system 500 may include, among other components, actuator 502, controller 504, building zone 506, zone temperature controller 524, and valve 546. In some embodiments, controller 504 is a primary controller for the components of an HVAC system (e.g., HVAC system 100) within the outer control loop 555 of feedback control system 500. In other embodiments, controller 504 is a thermostat or a BMS controller (e.g., for BMS 400). In still further embodiments, controller 504 is a user device configured to run a building management application (e.g., a mobile phone, a tablet, a laptop). Controller 504 may receive data from temperature sensor 508. Temperature sensor 508 may be any type of sensor or device configured to measure an environmental condition (e.g., temperature) of a building zone 506. Building zone 506 may be any subsection of a building (e.g., a room, a block of rooms, a floor, etc.).

Controller 504 is shown to include a digital filter 512, a wireless communications interface 518, and a comparator 520. Measured zone temperature data 510 from temperature sensor 508 may be received as an input signal to digital filter 512. Digital filter 512 may be configured to convert the measured zone temperature data 510 into a measured zone temperature feedback signal 514 that may be provided as an input to comparator 520. In some embodiments, digital filter 512 is a first order low pass filter. In other embodiments, digital filter 512 may be a low pass filter of a different order or a different type of filter.

Controller 504 is further shown to include wireless communications interface 518. In some embodiments, wireless communications interface 518 may communicate data from controller 504 to communications interface 552 of actuator 502. In other embodiments, communications interfaces 518 and 552 may communicate with other external systems or devices. Communications via interface 518 may be direct (e.g., local wireless communications) or via a communications network (e.g., a WAN, the Internet, a cellular network). For example, interfaces 518 and 552 may include a Wi-Fi transceiver for communicating via wireless communications network. In another example, one or both interfaces 518 and 552 may include cellular or mobile phone communications transceivers. In some embodiments, multiple controllers and smart actuator devices may communicate using a mesh topology. In other embodiments, communications interfaces 518 and 552 may be configured to transmit smart actuator device data (e.g., a fault status, an actuator and/or valve position) to an external network. In still further embodiments, communications interfaces 518 and 552 are connected via a wired, rather than wireless, network.

Comparator 520 may be configured to compare the measured zone temperature feedback signal 514 output from digital filter 512 with a zone temperature setpoint value 516. Comparator 520 may then output a temperature error signal 522 that is received by zone temperature controller 524. Comparator 520 may be a discrete electronics part or implemented as part of controller 504. If comparator 520 determines that the zone temperature feedback signal 514 is higher than the zone temperature setpoint value 516 (i.e., building zone 506 is hotter than the setpoint value), zone temperature controller 524 may output an error signal (e.g., zone temperature error 522) that causes actuator 502 to modify the flow rate through water coil 550 such that cooling to building zone 506 is increased. In some embodiments, zone temperature controller 524 may output a modified zone temperature error signal as described in greater detail below. If comparator 520 determines that the zone temperature feedback signal 514 is lower than the zone temperature setpoint value 516 (i.e., building zone 506 is cooler than the setpoint value), zone temperature controller 524 may output a control signal that causes actuator 502 to modify the flow rate through water coil 550 such that heating to building zone 506 is increased.

In various embodiments, zone temperature controller 524 is a pattern recognition adaptive controller (PRAC), a model recognition adaptive controller (MRAC), or another type of tuning or adaptive feedback controller. Adaptive control is a control method in which a controller may adapt to a controlled system with associated parameters which vary, or are initially uncertain. In some embodiments, zone temperature controller 524 is similar or identical to the adaptive feedback controller described in U.S. Pat. No. 8,825,185, granted on Sep. 2, 2014, the entirety of which is herein incorporated by reference.

In some embodiments, system 500 does not include zone temperature controller 524 and the functionality of zone temperature controller 524 is performed by controller 504. For example, controller 504 may be responsible for receiving zone temperature setpoint 516 and measured zone temperature feedback data 514, and transmitting zone temperature error 522 to flow/velocity span block 526, as shown in FIG. 5B. In other embodiments, the functionality of zone temperature controller 524 is not included within system 500.

Still referring to FIG. 5A, actuator 502 is shown to include a flow/velocity span block 526, a flow/velocity feedback controller 530, a drive device 540, and a communications interface 552. Zone temperature error 522 may be modified from comparator 520 to actuator 502 via zone temperature controller 524, resulting in flow/velocity span block 526 receiving modified zone temperature error 523. Zone temperature controller 524 may be responsible for modifying zone temperature error 522. For example, zone temperature controller 524 may be a PRAC controller as described above, that optimizes the error signal sent to flow/velocity span block 526 based on environmental patterns found within system 500. In the event that the zone temperature setpoint 516 is not an ideal temperature for flow/velocity feedback controller 530 to attempt to reach, zone temperature controller 524 may optimize (i.e., modify) zone temperature error 522 to achieve a modified zone temperature error 523, which may increase/decrease flow rate/velocity setpoint 528 resulting from flow/velocity span block 526 receiving zone temperature error 522. This error optimization may include changing the input into flow/velocity span block 526 based on non-ideal temperature (e.g., temperature spikes) within system 500. As referenced above, some or all of the functionality of zone temperature controller 524 may be performed controller 504, which may allow system 600 to only have two controllers: a primary controller (e.g., controller 504) and a secondary controller (e.g., flow/velocity feedback controller 530).

Flow/velocity span block 526 may be configured to enforce allowable maximum and minimum flow range limits on the received zone temperature error 522. For example, a technician installing the components of feedback control system 500 or an administrator of HVAC system 100 may input a maximum and/or a minimum flow range limit for the flow/velocity span block 526. In some embodiments, the flow range limits are transmitted via mobile device (e.g., a smart phone, a table) and are received via communications interface 552 of actuator 502. In other embodiments, the flow range limits are transmitted to interface 552 via wired network. As described in further detail below with reference to FIG. 8, the maximum and/or minimum flow range limits may be utilized in the calibration process of a flow rate sensor.

Flow/velocity feedback controller 530 is configured to receive a flow rate/velocity setpoint signal 528 from flow/velocity span block 526 and a flow rate/velocity feedback signal 532 from digital filter 538. Flow/velocity feedback controller 530 is further configured to output a command signal to drive device 540. In an exemplary embodiment, flow/velocity feedback controller 530 is a proportional variable deadband controller (PVDC) configured to implement a proportional variable deadband control technique. In other embodiments, flow/velocity feedback controller 530 is a pattern recognition adaptive controller (PRAC), a model recognition adaptive controller (MRAC), or another type of tuning or adaptive feedback controller. In other embodiments, flow/velocity feedback controller 530 operates using state machine or proportional-integral-derivative (PID) logic.

Flow/velocity feedback controller 530 may be configured to output an actuator control signal (e.g., a DC signal, an AC signal) to drive device 540. Drive device 540 may be any type of controllable device configured to operate (e.g., move, rotate, adjust, etc.) valve 546. For example, drive device 540 may be a linear actuator (e.g., a linear proportional actuator), a non-linear actuator, a spring return actuator, or a non-spring return actuator. Drive device 540 may include a drive device coupled to valve 546 and configured to rotate a shaft of valve 546. In various embodiments, valve 546 may be a 2-way or 3-way two position electric motorized valve, a ball isolation valve, a floating point control valve, an adjustable flow control device, or a modulating control valve.

Still referring to FIG. 5A, feedback control system 500 is further shown to include a flow rate sensor 548. Flow rate sensor 548 may be any type of flow rate sensor. For example, in various embodiments, flow rate sensor 548 may be an ultrasonic transducer flow sensor, a heated thermistor flow sensor, or a vortex-shedding flowmeter. In some embodiments, flow rate sensor 548 may be disposed upstream of valve 546 to measure the flow rate and/or velocity of fluid entering valve 546. In other embodiments, flow rate sensor 548 may be disposed downstream of valve 546 to measure the flow rate and/or velocity of fluid exiting valve 546. Once collected, measured flow rate and/or velocity data 542 from flow rate sensor 548 may be provided to flow/velocity feedback controller 530 of actuator 502. In various embodiments, flow sensor 548 may be any type of device (e.g., ultrasonic detector, thermistor, paddle-wheel sensor, pitot tube, drag-force flowmeter) configured to measure the flow rate or velocity using any applicable flow sensing method.

Fluid that passes through valve 546 may flow through water coil 550. In some embodiments, valve 546 is used to modulate an amount of heating or cooling provided to supply air for building zone 506. For example, valve 546 may be located within an air duct, air handling unit, rooftop unit, fan coil unit, or other airflow device that provides supply air to building zone 506. In various embodiments, water coil 550 may be used to achieve zone setpoint temperature 516 for the supply air of building zone 506 or to maintain the temperature of supply air for building zone 506 within a setpoint temperature range. The position of valve 546 may affect the amount of heating or cooling provided to supply air via coil 550 and may correlate with the amount of energy consumed to achieve a desired supply air temperature.

Referring now to FIG. 5C, another embodiment of feedback control system 500 is shown. Feedback control system 500 includes cooling coil 550 within building zone 506. Cooling coil 550 may be located inside or proximate to the building zone 506 such that fluid may leave cooling coil 550 and progress through waterside system 200 (e.g., to subplant 208, etc.). Feedback control system 500 further shows zone temperature controller 524 providing flow/rate velocity setpoint 528 to flow/velocity feedback controller 530. In some embodiments, zone temperature controller 524 directly provides a setpoint (i.e., flow/rate velocity setpoint 528) to the actuator 502, and does not modify the error signal as shown in FIGS. 5A-B. Rather, zone temperature controller 524 may span zone temperature error 522 and directly provide a setpoint for actuator 502. Any signal processing necessary to span zone temperature error 522 into flow rate/velocity setpoint 528 may be performed in zone temperature controller 524, flow/velocity feedback controller 530, or a combination of both.

Flow Sensor Calibration for Pressure Independent Valve Assembly

Figure 6A:
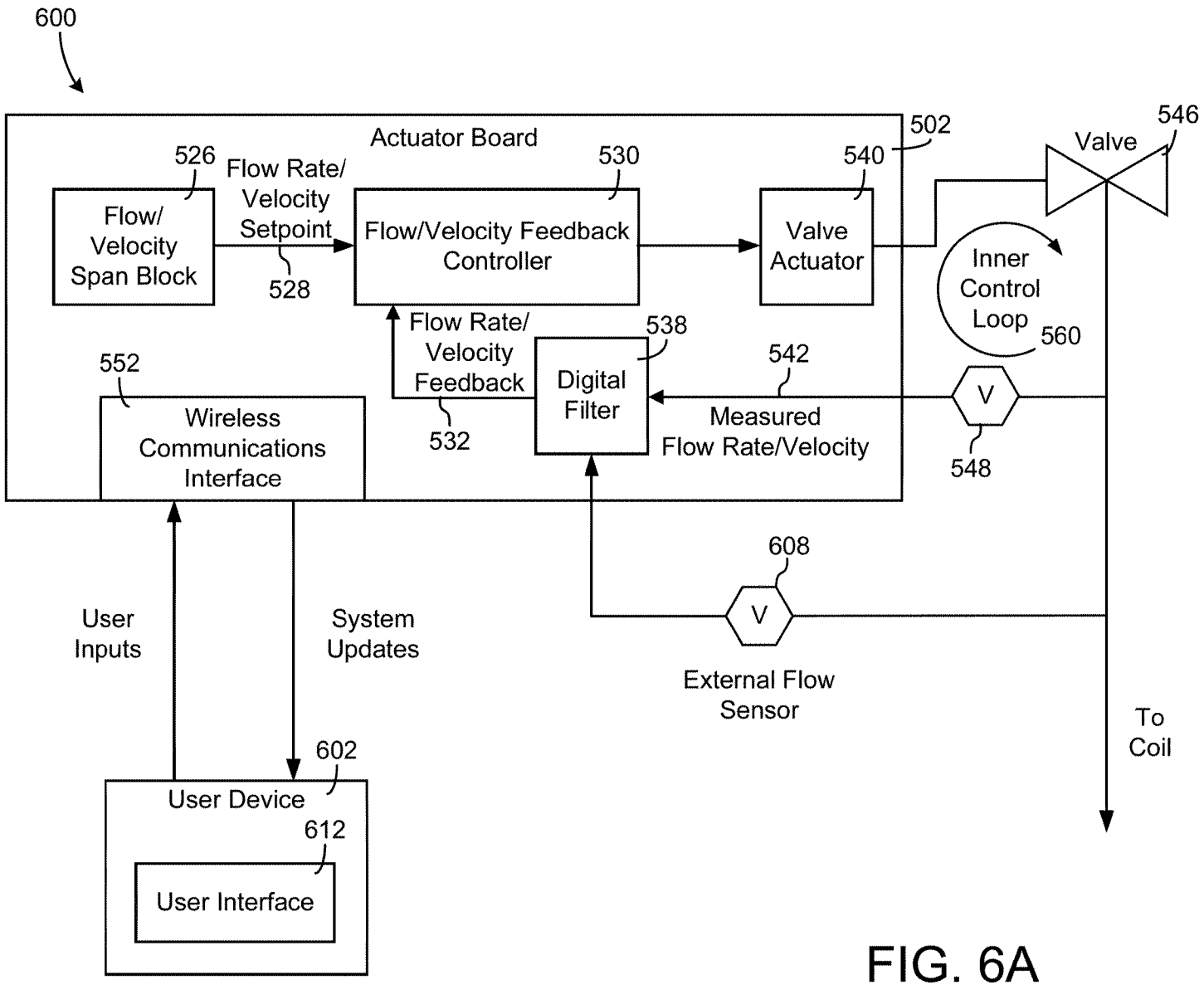
FIG. 6A is a block diagram of a flow sensor calibration system that can be utilized in the feedback control system of FIGS. 5A-B, according to some embodiments.

Referring now to FIG. 6A, a block diagram of a flow sensor calibration system 600 is shown. Flow sensor calibration system 600 is shown to include actuator 502, a user device 602, and an external flow sensor 608. In some embodiments, flow sensor calibration system 600 can be operated within feedback control system 500 as described above with reference to FIG. 5A-C.

System 600 may be configured to execute a calibration test of flow sensor 548. The calibration test (i.e., test) may be performed by one or more processing circuits inside of actuator 502 (e.g., inside of flow/velocity feedback controller 530). In some embodiments, the test includes an algorithm to calibrate one or more flow sensors using the capabilities of actuator 502 where actuator 502 is a smart actuator. Actuator 502 can include some or all of the components of the actuators as described in greater detail in U.S. Pat. No. 9,746,199 granted Aug. 29, 2017, and U.S. application Ser. No. 15/901,843 filed Feb. 21, 2018, both of which are incorporated by reference herein in their entireties. The particular components of system 600 configured to calibrate flow sensor 548 are described in greater detail with reference to FIG. 9.

User device 602 may be any device capable of displaying a graphical user interface for a user (e.g., phone, laptop, desktop monitor, building network station, etc.). User device 602 is shown to include a user interface 612. In some embodiments, user interface 612 is a graphical user interface that permits a user to interact, monitor, and calibrate flow sensor 548 through user device 602. For example, user interface 612 permits a user to initiate and monitor flow sensor calibration process 800, described in further detail below with reference to FIG. 8. User interface 612 may receive user inputs that include but are not limited to a reference flow measurement. For example, a user may input a flow value (e.g., 20 gallons per minute) that user device 602 transmits to interface 552. This value may then be used as the reference flow measurement for calibrating flow sensor 548. In some embodiments, user interface 612 allows the user to monitor the status and progress of the test. User device 602 may be communicably coupled to interface 552. In some embodiments, user device 602 includes an Ethernet card and port for sending and receiving data via an Ethernet-based communications link or network. In other embodiments, includes a Wi-Fi transceiver for communicating via a wireless communications network.

User device 602 is further shown to receive system updates from actuator 502. In some embodiments, actuator 502 may need to commission (e.g., update) any processing or functionality to improve operation of the actuator. For example, actuator 502 receives an update, by means of an external source (e.g., a user, through network 446, etc.) to update calibration process 800. In other embodiments, user device 602 may receive updates regarding the status of the calibration process for flow sensor 548. This may include notifying the user of the completed steps throughout the process, and notifying the user when the calibration process is complete. Notifications and updates to user device 602 regarding the calibration process is described in greater detail with reference to FIGS. 7A-C. User device 602 may be updated and/or notified of an update regarding actuator 502 by means of wireless communications interface 552.

External flow sensor 608 may be configured to monitor the flow rate through valve 546 and act as a reference flow measurement for calibrating flow sensor 548. External flow sensor 608 may be calibrated outside of system 600 (e.g., at a factory, machine calibrated, etc.). In some embodiments, flow sensor 548 and external flow sensor 608 may be coupled to actuator 502 in parallel, with both providing independent flow measurements to the internal controller of actuator 502 (e.g. flow/velocity feedback controller 530). In other embodiments, external flow sensor 608 may be detachably coupled to actuator 502 such that it is only included in flow sensor calibration system 600 when an active calibration of flow sensor 548 is in process. In various embodiments, external flow sensor 608 may be any type of flow sensing device (e.g., ultrasonic detector, thermistor, paddle-wheel sensor, pitot tube, drag-force flowmeter). Exemplary user interfaces and an exemplary process for calibrating flow sensor 548 are described in greater detail with reference to FIGS. 7A-8. The calibration process performed by system 600 is described in greater detail with reference to FIG. 9.

In some embodiments, system 600 does not include external flow sensor 608. External flow sensor 608 acts as a source of a reference flow measurement flow measurement as described in detail in FIGS. 7A-C. This reference flow measurement may be established in ways other than an externally-calibrated sensor. For example, the reference flow measurement by be a predetermined value provided by a user or technician that may be static in value. In another embodiment, the reference flow measurement changes based on user input.

In some embodiments, digital filter 538 may filter data from both externally calibrated flow sensor 608 and flow sensor 548. The output from digital filter 538 (e.g., flow rate/velocity feedback 532) may include data from flow sensor 548 (e.g., measured flow rate/velocity 542), data from external flow sensor 608, user-defined reference value (not shown in FIG. 6A), or any combination thereof. Flow rate/velocity feedback 532 may act as the data set utilized in generating a calibration process (e.g., calibration curve) to calibrate flow sensor 548. This calibration process is described in greater detail with reference to FIG. 9.

Figure 6B:
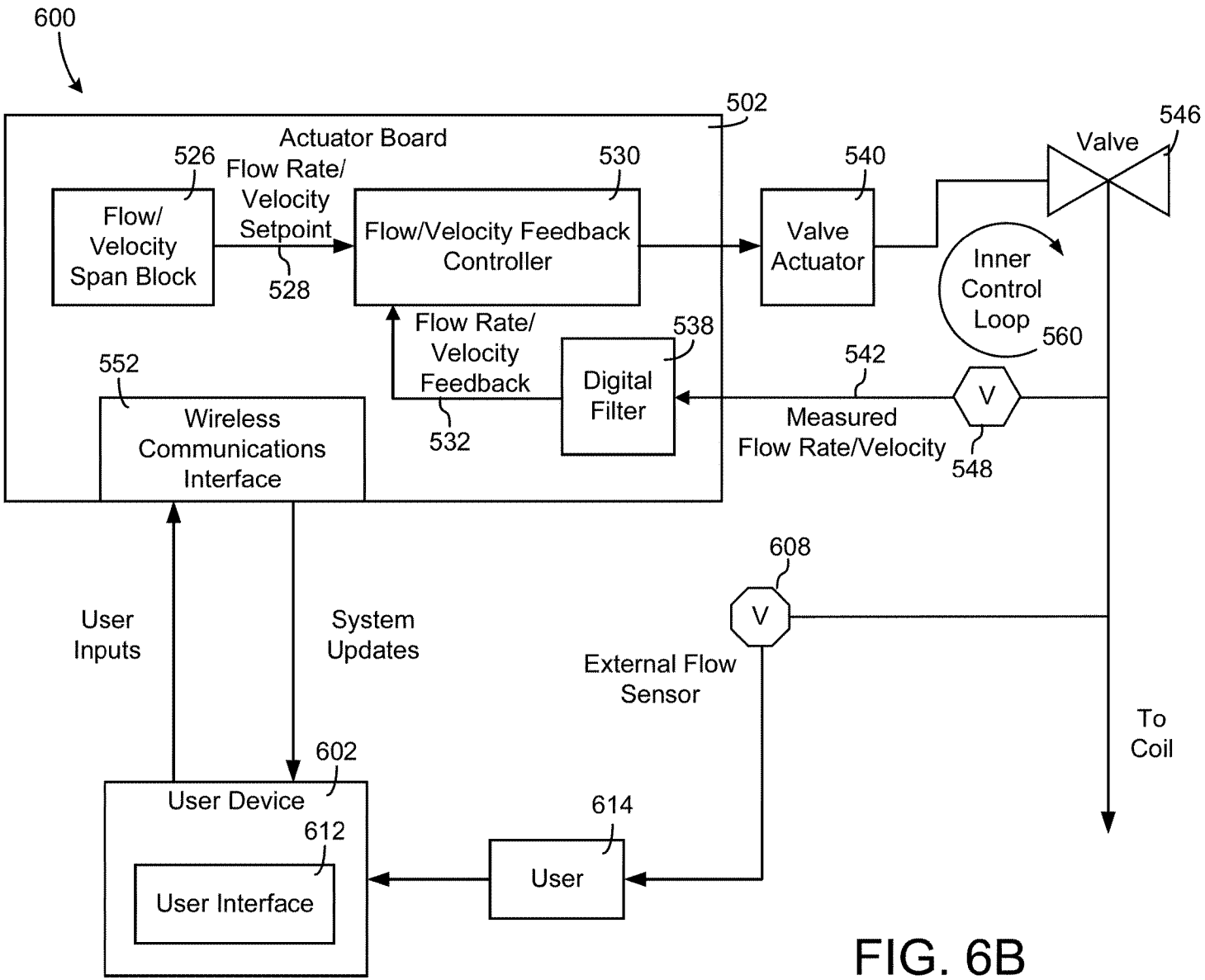
FIG. 6B is a block diagram of a flow sensor calibration system that can be utilized in the feedback control system of FIGS. 5A-B, according to some embodiments.

Referring now to FIG. 6B, another embodiment of flow calibration system 600 is shown. Flow calibration system is shown to include user 614. User 614 may be an individual operating user device 602 (e.g., technician, customer, etc.). In various embodiments, external flow sensor 608 may provide flow measurements to user 614. User 614 may then provide those flow measurements to actuator 502, via user device 602. For example, external flow sensor 608 may measure a fluid at a rate of 20 gallons per minute. User 614 may observe the reading from external flow sensor 608 via an interface (e.g., a graphical user interface on external flow sensor 608, etc.) and enter the flow measurement into user device 602, via user interface 612. User device 602 may provide the flow measurement to actuator 502 via wireless communications interface 518. Communication between user device 602 and actuator 502 may be wireless or wired, as described above.

Still referring to FIG. 6B, actuator 502 may not include drive device 540 in some embodiments. In some embodiments, actuator 502 handles all processing (e.g., spanning, controlling, filtering, communications, etc.) required by actuator 502, and provides a command signal to drive device 540 to control valve 546.

Figure 7A:
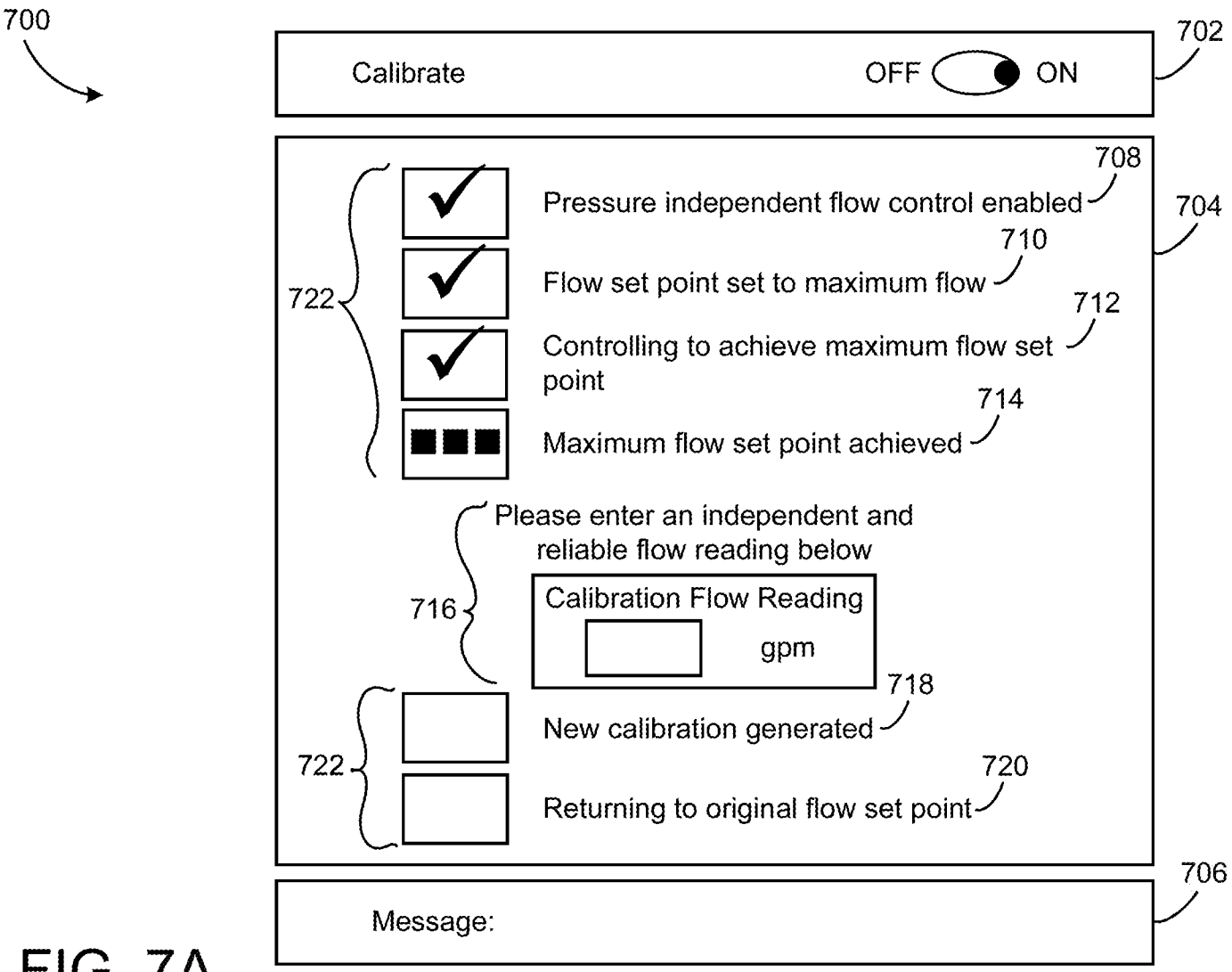
FIG. 7A is a user interface which can be used as part of the flow sensor calibration system of FIGS. 6A-B, according to some embodiments.
Figure 7B:
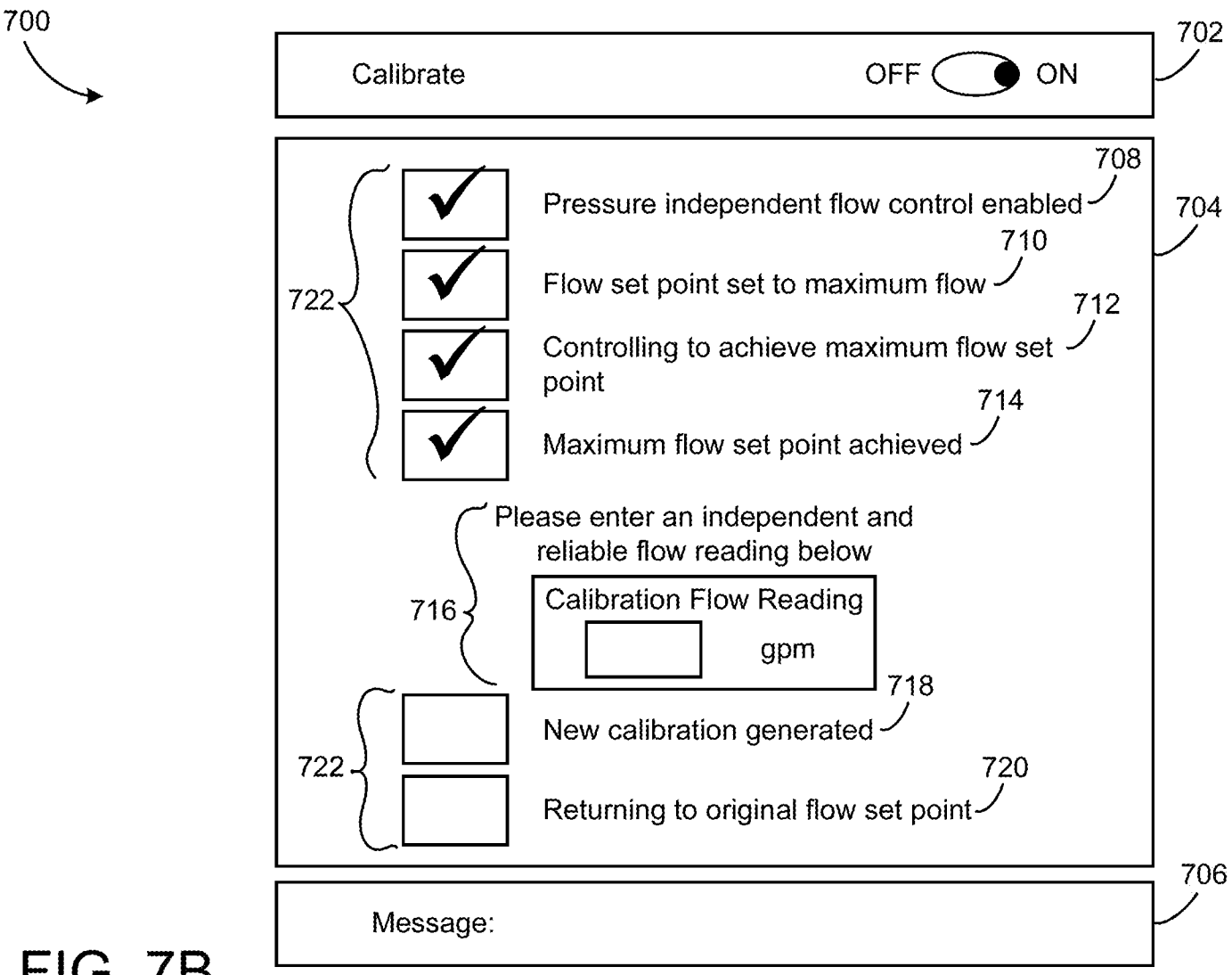
FIG. 7B is a user interface which can be used as part of the flow sensor calibration system of FIGS. 6A-B, according to some embodiments.
Figure 7C:
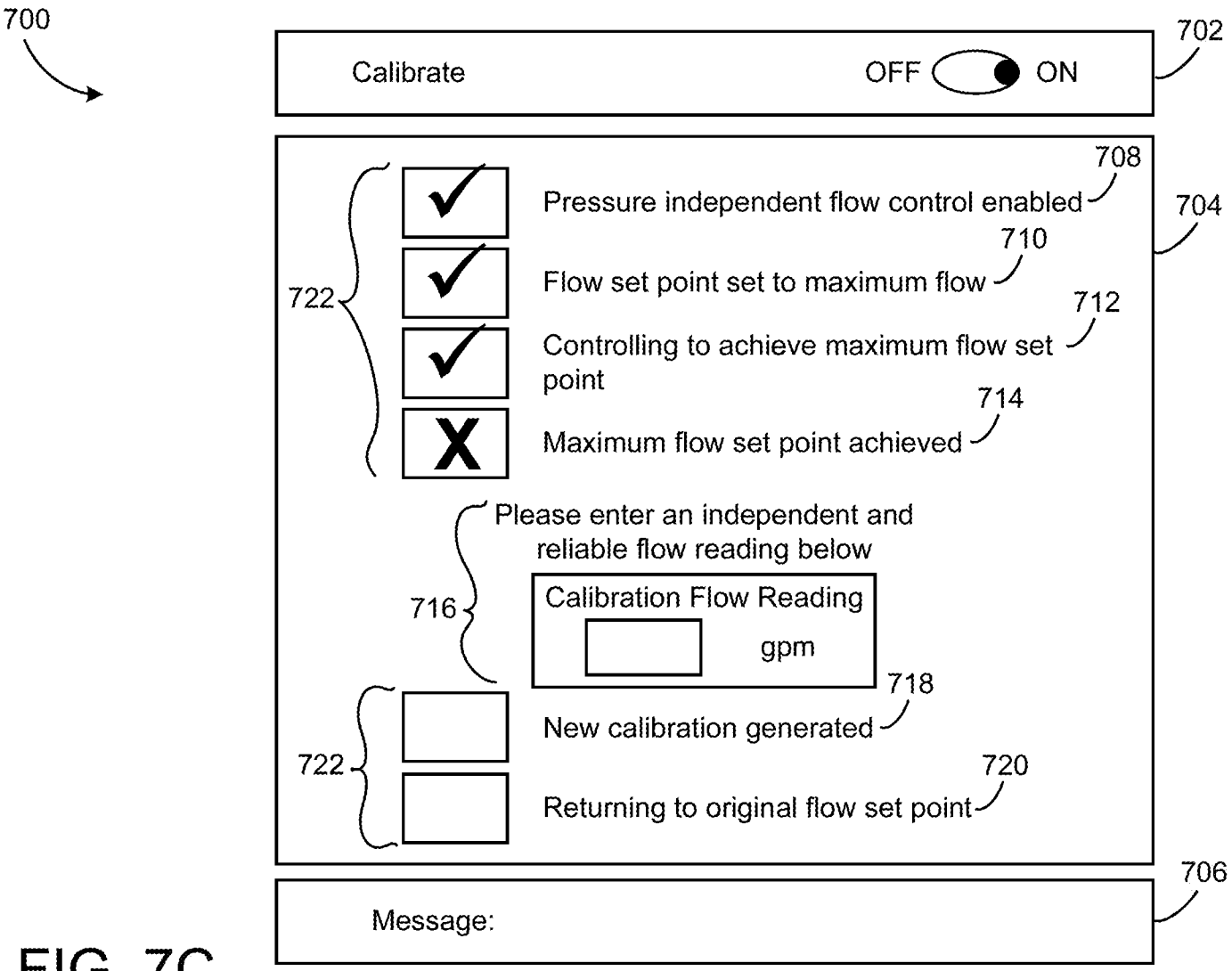
FIG. 7C is a user interface which can be used as part of the flow sensor calibration system of FIGS. 6A-B, according to some embodiments.

Referring now to FIGS. 7A-C, a flow calibration user interface 700 is shown, according to an exemplary embodiment. FIGS. 7A-C show various steps and the status of the various steps throughout the test on flow calibration user interface 700. In various embodiments, flow calibration user interface 700 may be accessed and displayed on user device 602, as described above with reference to FIG. 6A. In other embodiments, flow calibration user interface 700 may be accessed and displayed using a different device, such as a supervisory controller (e.g., BMS controller 366) via a cloud server.

User interface 612 may be generated internally (e.g., within the operating system) of user device 602. User interface 612 may include any functionality by which a user and a computer system interact, particularly through input devices (e.g., switches, keypads, touchscreens, etc.) and software. In some embodiments, a user interacts with user device 602 (e.g., begins the calibration process). The command from the user may be transmitted to processing within actuator 502 via wireless communications interface 552 to instruct actuator 502 to perform certain actions. User interface 612 may also receive system updates, such as status updates 708-720 as described in FIGS. 7A-C.

Flow calibration interface 700 may be configured to display to a user the process and status of each step in the calibration test. In some embodiments, the test is substantially similar to calibration process 800, described below with reference to FIG. 8. The flow calibration interface 700 is shown to include, among other components, a calibration widget 702, a status checklist widget 704, and a message widget 706. In one example, the calibration widget 702 includes a toggle button that permits a user to initiate the calibration process by moving the toggle button to the "ON" position. If a user wishes to halt the calibration process once initiated, the user may move the toggle button the "OFF" position.

Each of the status updates (e.g., "steps") 708-714 and 718-720 in status checklist widget 704 are shown to have a corresponding check-box (referred to collectively as check-boxes 722). In some embodiments, the check-boxes 722 may display a green checkmark icon when the result of the associated status update component 708-714 and 718-720 is determined to be a success and a red "X" icon when the result is determined to be a failure. In some embodiments, the check-boxes 722 may display a loading icon (e.g., three dots in a line) as shown in FIG. 7A to indicate that the step is currently in progress. For example, in FIG. 7A, step 712 is shown to be completed and step 714 is shown to be in progress. In this way, a user performing a calibration process advantageously receives feedback at each step in the process, permitting a user to monitor the success or failure of the test in real-time. The status checklist widget 704 is shown to be disposed below the calibration widget 702 and may include status update components 708-720. The status update components 708-720 may be generated and monitored by flow/velocity feedback controller, described below with reference to FIG. 9.

Status update 708 is shown to display "Pressure independent flow control enabled." In some embodiments, actuator 502 may need to transition from operation in the valve command mode to operation in the pressure independent flow control mode. In the pressure independent flow control mode, flow through valve 546 may be controlled to modulate a constant flow rate regardless of pressure changes in the system. This is described in greater detail with reference to FIG. 9.

Status update 710 displays the task "Flow set point set to maximum flow." In some embodiments, this step includes flow velocity feedback controller 530 establishing a maximum flow setpoint for valve 546. In some embodiments, the maximum flow setpoint is determined by actuator 502. In other embodiments the maximum flow setpoint is determined by a user via the user device 602, or is a factory setting. In various embodiments, the maximum flow setpoint corresponds with a fully open (i.e., 100% open) position of the valve 546 or near fully open (e.g., 85-95% open).

Status update 712 displays "Controlling to achieve maximum flow set point." In some embodiments, status update 712 includes actuator 502 sending a valve position command to valve 546 to open to a position corresponding with a maximum flow setpoint. In other embodiments, status update 712 includes actuator 502 sending a valve position command to valve 546 to open to a position corresponding with a various flow setpoint values (e.g., 10 gpm, 20 gpm, etc.). In various embodiments, valve 546 is commanded to move into a variety of positions, which may or may not be predetermined. For example, flow/velocity feedback controller 530 may send a valve position command to valve 546 to move into a first position (i.e., 20% open), a second position (i.e., 40% open), a third position (i.e., 60% open), a fourth position (i.e., 80% open), and a fifth position (i.e., 100% open). At each position, flow measurements may be recorded by flow sensor 548 or external flow sensor 608 or both. In general, flow/velocity feedback controller 530 may cause valve 546 to automatically move into multiple different positions and automatically record a flow measurement at one or more positions for use in the calibration process.

In some embodiments, flow sensor 548 and/or external flow sensor 608 may experience sensor measurement saturation. Sensor measurement saturation may include any saturation effect wherein a measurement device (e.g., flow sensor 548 and/or external flow sensor 608) is unable to provide accurate reading based on limiting design specifications of the measurement device. For example flow sensor 548 and/or external flow sensor 608 may be a 4-20 mA flow sensor, wherein a flow 4 mA current reading corresponds to the minimum flow rate that can be measured by flow sensor 548 and/or external flow sensor 608 (e.g., a 0 flow rate) and 20 mA current reading corresponds to the maximum flow rate that can be measured by flow sensor 548 and/or external flow sensor 608 (e.g., 20 gpm), also referred to as the design flow rating. If flow sensor 548 and/or external flow sensor 608 were to measure a flow greater than the design flow rating (e.g., 26 gpm), flow sensor 548 and/or external flow sensor 608 may report the flow rate as 20 gpm due to sensor measurement saturation. In some embodiments, fluid through system 600 may be pumped at a pressure that is significantly greater than normal operation. In such an embodiment, the flow rate may increase and flow sensor 548 and/or external flow sensor 608 may measure the flow at a value that is lower than the actual flow rate through the piping, due to sensor saturation.

Advantageously, flow sensor calibration system 600 may compensate for sensor measurement saturation by controlling to a flow rate setpoint (e.g., a target flow rate) when calibrating flow sensor 548. For example, in response to receiving a request to enter a calibration mode, flow sensor calibration system 600 may automatically command a flow control device (e.g., flow/velocity feedback controller 530, drive device 540, and/or valve 546) to achieve a target flow rate. In various embodiments, this may be accomplished by providing the target flow rate as a new flow setpoint to flow/velocity feedback controller 530 (e.g., from flow/velocity span block 526), retrieving the target flow rate from memory within flow/velocity feedback controller 530, or otherwise causing flow/velocity feedback controller 530 to operate drive device 540 to achieve the target flow rate. Measurements from flow sensor 548 and/or external flow sensor 608 can be used as feedback to determine whether the flow rate of the fluid through the conduit is approaching the target flow rate. Once the target flow rate has been achieved (e.g., measurements from flow sensor 548 and/or external flow sensor 608 are substantially equal to the target flow rate), flow sensor calibration system 600 may proceed to generate calibration data for flow sensor 548 using a flow measurement from flow sensor 548 and a corresponding reference flow value (e.g., from external flow sensor 608, from a user, from memory, etc.).

In some embodiments, flow/velocity feedback controller 530 is configured to operate drive device 540 to achieve a valve position. For example in response to receiving a request to enter a calibration mode, flow sensor calibration system 600 may automatically command a flow control device (e.g., flow/velocity feedback controller 530, drive device 540, and/or valve 546) to achieve a valve position of valve position for valve 546. The command may be based on a percentage of the maximum that valve 546 can open to (e.g., 50% open, 80% open, 100% open, etc.). Measurements received from flow sensor 548 and/or external flow sensor 608 can be used as feedback to determine whether valve 546 is at its intended position. This may be accomplished by using information stored in memory on flow/velocity feedback controller 530 that relates various flow measurements through valve 546 with a certain level of valve actuation (e.g., how "open" the valve is). In various embodiments, flow/velocity feedback controller 530 is configured to operate drive device 540 to achieve a valve position by either achieving a target flow rate or a valve position. For example, flow sensor calibration system 600 may be under an operation such that sensor measurement saturation is not a current and significant issue. As such, operating drive device 540 to achieve a target flow rate may not be necessary, and operating drive device 540 can instead achieve a target valve position.

In some embodiments, the flow/velocity feedback controller 530 may also increase a pump speed to increase a branch inlet pressure (e.g., increase pressure inside valve 546). Status update 714 may display "Maximum flow setpoint achieved," if the maximum flow is reached. This step may be achieved when the flow/velocity feedback controller 530 has maximized the potential flow through valve 546. Completion of this step is shown in FIG. 7B, where indicator component 722 shows a green check mark near status update 12. In FIG. 7A, a loading icon is shown to indicate that system 600 is current attempting to achieve the maximum flow setpoint.

Status update 716 displays for the user "Please enter an independent and reliable flow reading below," and includes a widget (e.g., user input box) for a user to input a value. This value may be determined from external flow sensor 608. In some embodiments, the reading from external flow sensor 608 is displayed to user device 602. Once this value is received and the test is on step 714, the user may input the value received by external flow sensor 608. This value may be in units of gallons per minute (gpm) or liters per second (lps). Step 716 may be established to give a reference value for flow sensor 548. For example, the maximum flow rate measured by external flow sensor 608 is 200 gpm. The user receives flow measurements that indicate the flow rate is 200 gpm, per the external flow sensor 608, and 180 gpm, per flow sensor 548. The user is now able to see that flow sensor 548 requires calibration. Any type of flow rate, including various different suitable units of flow rate may be measured by both flow sensor 548 and external flow sensor 608. In some embodiments, status update 716 is not entered into the checklist widget 704 and is instead entered into a message widget 706 or another window inside of status checklist 704.

Figure 9:
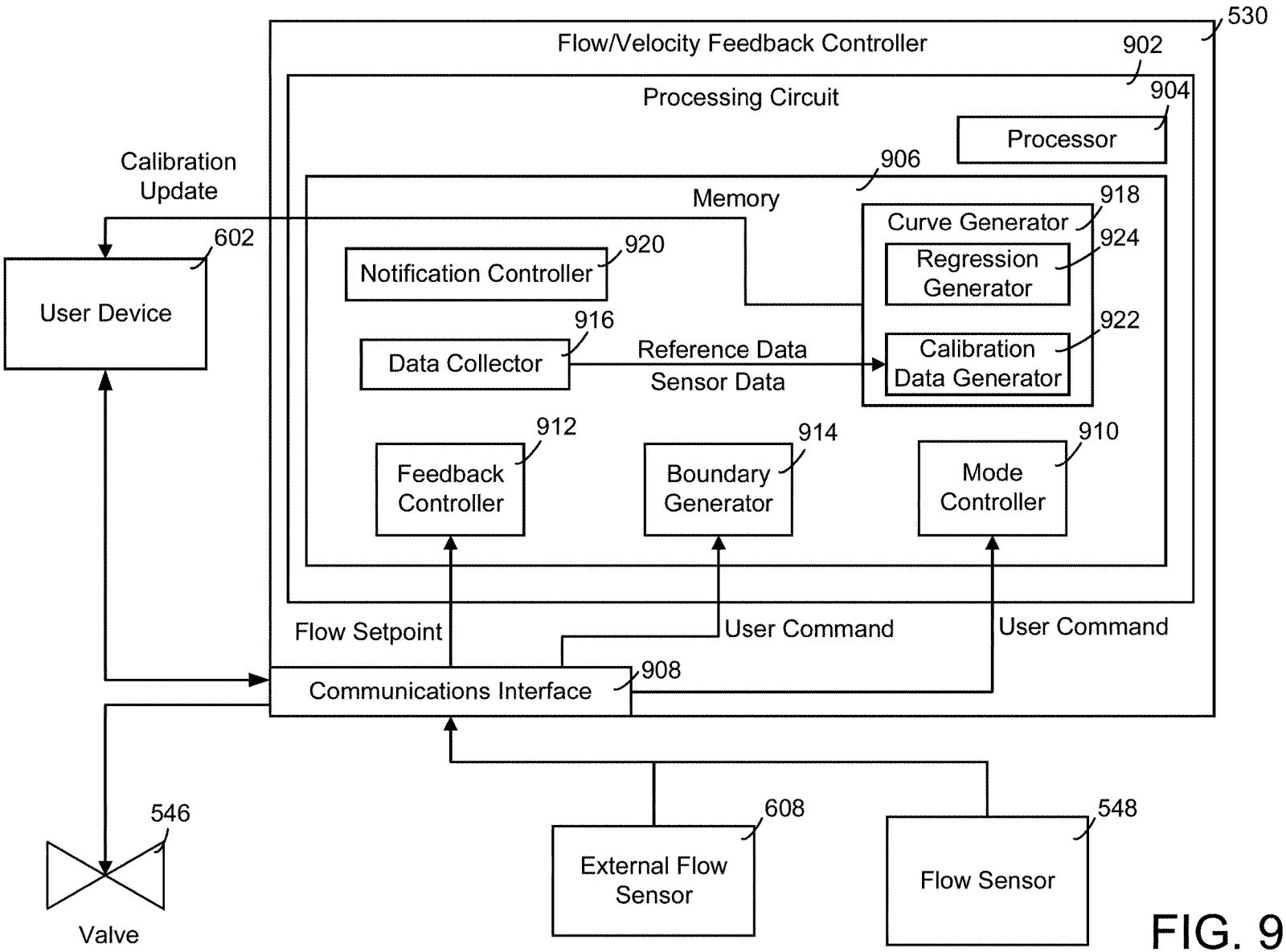
FIG. 9 is a block diagram of a flow/velocity feedback controller which can be used as part of the flow sensor calibration system of FIGS. 6A-B, according to some embodiments.

Status update 718 displays "New calibration generated." Step 718 may include calibrating flow sensor 548 to ensure substantially accurate readings are received by flow sensor 548. This step may be performed using the calibration data generated by flow/velocity feedback controller 530, as shown in FIG. 9. The calibration process is described in greater detail with reference to FIG. 9. Status update 720 displays "Returning to original flow set point." In some embodiments, the calibration process will no longer need to achieve maximum flow after flow sensor 548 has been calibrated. As such, the set point for flow/velocity feedback controller 530 can return to standard operating levels.

Still referring to FIG. 7A, check-boxes 722 may be images or icons on interface 700 that represent the progression of the steps in status checklist 704. For example, when step 712 has been completed but step 714 has not begun, interface 700 may leave the box proximate to the text string of step 714 empty. When step 714 begins, interface 700 may update the box to include an image representative of a pending process (e.g., dots, loading circle, etc.), as shown in FIG. 7A. When step 714 is completed, interface 700 will update by placing a checkmark in the box proximate the text string of step 714, as shown in FIG. 7B. If a step in status checklist 704 fails, interface 700 may update by placing a "failure" symbol (e.g., red "X") in the box proximate to the text string of step 714, as shown in FIG. 7C.

Still referring to FIG. 7, flow calibration user interface 700 is further shown to include a message widget 706 disposed below the status checklist widget 704. In other embodiments, message widget 706 is configured to display more detailed information for the user (e.g., total calibration time, plant parameters, system parameters, temperature values, pressure values, flow value, etc.). In other embodiments, message widget 706 can be configured to allow a user to input a command to change the calibration process.

Figure 8:
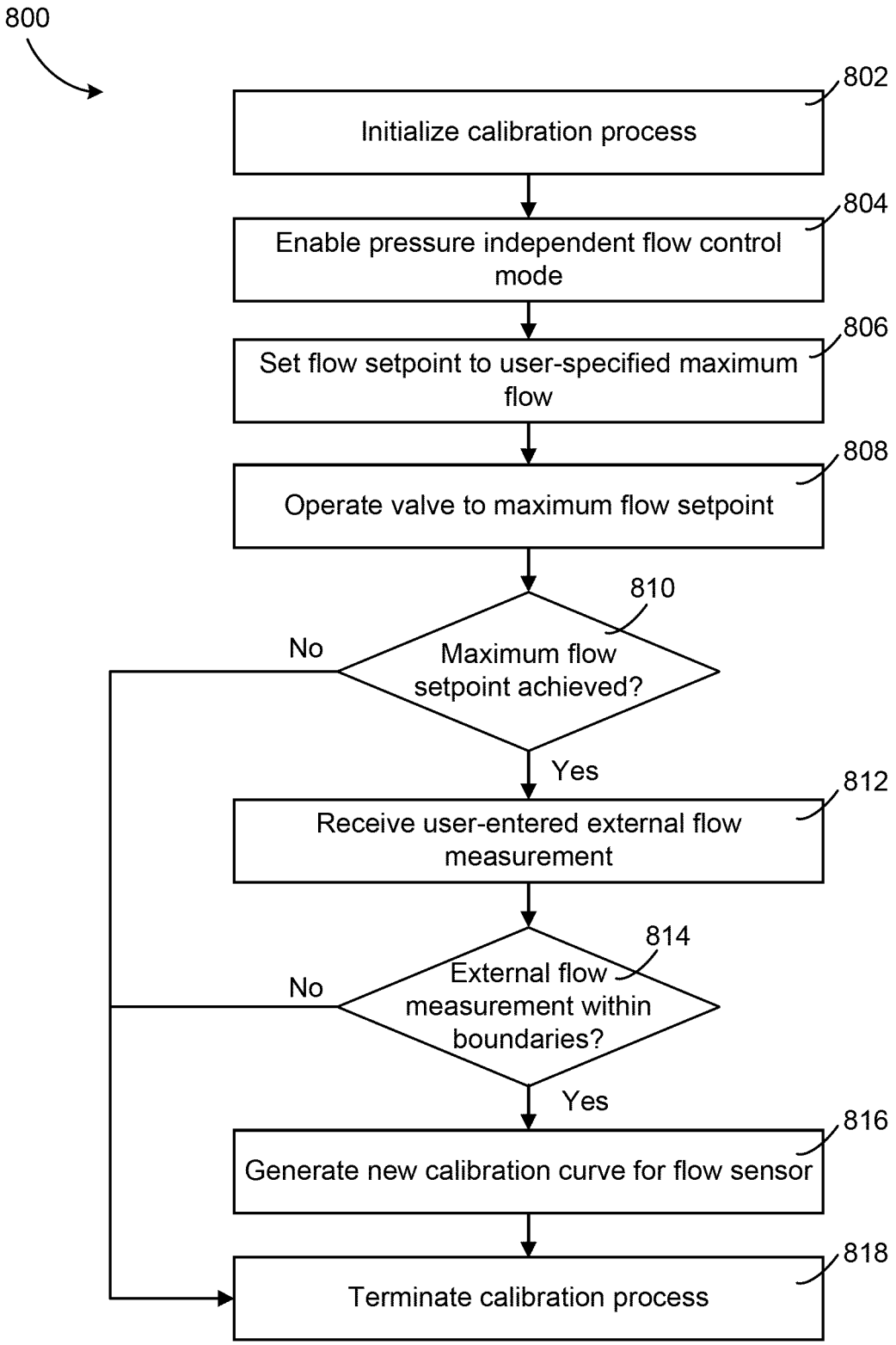
FIG. 8 is a flow diagram of a flow sensor calibration process that can be implemented by the flow sensor calibration system shown in FIGS. 6A-B, according to some embodiments.

Referring now to FIG. 8, a flow diagram of a process for calibrating a flow sensor (e.g., flow sensor 548) is shown, according to an exemplary embodiment. Process 800 may be implemented by one or more components of flow sensor calibration system 600, as described above with reference to FIGS. 6A-B. For example, process 800 may be performed by flow/velocity feedback controller 530 and user device 602. Flow/velocity feedback controller 530 may hand the processing and control logic of process 800, while user device 602 may display user interface 700 to permit a user to view and control various steps of the calibration process 800. In other embodiments, calibration process 800 can be implemented by any controller in the BMS system (e.g., BMS controller 366). In some embodiments, process 800 may be implemented as part of a state machine.

In some embodiments, flow/velocity feedback controller 530 may not alter the flow rate velocity setpoint 528 during process 800. Flow/velocity feedback controller 530 may implement calibration process 800 and begin the steps necessary to complete process 800. In some embodiments, flow/velocity feedback controller 530 may receive a different temperature flow rate/velocity setpoint 528 that differs from the setpoint value used for process 800 after process 800 has begun. Flow/velocity controller 530 may continue process 800 and not alter or recognize the new value for flow/rate/velocity setpoint 528 until the calibration process 800 is complete.

Process 800 is shown to include initializing the calibration process (step 802). In some embodiments, flow/velocity feedback controller 530 receives instructions to enter a calibration mode when a user wants to calibrate flow sensor 548. These instructions may be provided by a user. For example, a user may transmit instructions from user device 602 to flow/velocity feedback controller 530 to begin the calibration test of flow sensor 548. In various embodiments, entering the calibration mode may first require a user to communicably couple the user device 602 to the flow/velocity feedback controller 530, and/or an external sensor device such as external flow sensor 608 to actuator 502. The user device 602 and the external flow sensor 608 may be coupled to the flow/velocity feedback controller 530 using wired or wireless methods. In some embodiments, the flow/velocity feedback controller 530 initiates the command to enter a calibration mode based on a signal transmitted from the user device 602 to the flow/velocity feedback controller 530. For example, the user device 602 may generate a signal to the flow/velocity feedback controller 530 to enter the calibration mode when a user moves a toggle button on the calibration widget 702 to the "ON" position.

Process 800 is shown to continue with the flow/velocity feedback controller 530 enabling the actuator 502 to operate in a pressure independent control mode (step 804). In some embodiments, actuator 502 has various modes of operation, including a pressure-independent control mode. In some embodiments, the pressure-independent control mode allows for static pressure within valve 546 to ensure a more accurate testing. As pressure increases, temperature of the fluid within valve 546 increases which may affect the results of the calibration test. Details of the different modes of operation for flow/velocity feedback controller 530 are described in greater detail with reference to FIG. 9.

Process 800 is shown to include setting the flow setpoint to a user specified maximum flow (step 806). In some embodiments, the maximum flow setpoint is determined based on the specifications of valve 546, a user input, current system specifications (e.g., current max pump speed, chiller/boiler specifications, etc.), or any combination thereof. The setpoint may be any value between the maximum rated flow of valve 546 and zero. For example, the maximum flow rate valve 546 is capable of producing is 400 gpm, and the maximum flow setpoint is 380 gpm. In other embodiments, the maximum flow setpoint is the same value as the maximum flow rate valve 546 is capable of producing. Process 800 is shown to include operating the valve to achieve the maximum flow setpoint (step 808). Actuator 502 may send a valve position command to valve 546 to reach the flow setpoint established.

Process 800 is further shown to include determining if the maximum flow setpoint has been achieved (step 810). In the exemplified embodiment, step 810 refers to the actions taken by flow/velocity feedback controller 530 (e.g., sending a valve position command to actuator 502 to increase the flow rate, increasing pump pressure, increasing pump speed, etc.). In some embodiments, determining if the flow setpoint has been reached is based on monitoring an error signal entering flow/velocity feedback controller 530. If the error signal reaches zero, the flow setpoint has been reached. This is described in greater detail with reference to FIGS. 5A-B above. If the flow setpoint is not reached, the calibration process may end and a notification signal may be sent to interface 700 to update accordingly, as shown in step 818. If maximum flow is achieved, interface 700 updates accordingly and the user is prompted for an input, as shown in step 812.

In some embodiments, sensors 548, 608 are part of the calibration test and would not be accurate references to determine if the maximum flow rate has been reached. Flow/velocity feedback controller 530 may determine that maximum flow has been achieved based on a predetermined threshold for valve 546 (e.g., 200 gpm). In other embodiments, the user sets the threshold based on the valve specifications. In other embodiments, the externally-calibrated flow sensor acts as the reference to determine if maximum flow has been achieved.

Referring generally to steps 802-808, flow/velocity feedback controller 530 is attempting to achieve the highest rated flow through valve 546. This is done by flow/velocity feedback controller 530 receiving a flow setpoint that is at or near the maximum flow that valve 546 is capable of producing. Step 810 is established to take certain action based on whether the maximum flow is reached.

Process 800 is shown to include receiving user-entered external flow measurement (step 812). In some embodiments, a user will enter the flow measurement taken from external flow sensor 608, wherein both sensors 548, 608 are measuring the flow rate of the same flow. External flow sensor 608 may be calibrated externally and found to be substantially reliable. As such, a user is prompted on interface 700 to input the value from external flow sensor 608 to act as a reference when calibrating flow sensor 548.

Process 800 is shown to include determining if the flow measurement from external flow sensor 608 is within upper and lower bounds (step 814). This step may take the flow measurement provided by the user and determine if this value is within predetermined bounds established within flow/velocity feedback controller 530. If the reading is not within the boundary conditions established (e.g., bounds), the calibration process ends in failure and interface 700 updates accordingly. In the event of a failed calibration test, updating interface 700 includes notifying the user of the eminent problem observed in the calibration process. More specifically, interface 700 may be updated such that the user sees the cause of the failure at the exact step in process 800. Details of notifying the user in the event of a failed calibration test are described in greater detail with reference to FIG. 9. If the reading is within the established bounds, flow velocity feedback controller 530 may calibrate flow sensor 548 accordingly, as shown in step 816.

Process 800 is shown to include generating a new calibration curve for a flow sensor (step 818). In some embodiments, flow/velocity feedback controller 530 may manipulate or alter the flow measurements received from flow sensor 548 such that the readings received from flow sensor 548 are substantially closer in value to flow measurements received from external flow sensor 608. In some embodiments, the values from flow sensor 548 are off by a constant factor, and flow/velocity feedback controller 530 compensates for the factor by scaling the received flow measurements from flow sensor 548. In various embodiments, flow sensor 548 will need to be calibrated in various manners to generate substantially similar results between external flow sensor 608 and flow sensor 548 after calibration.

Referring now to FIG. 9, a detailed block diagram of flow/velocity feedback controller 530 is shown, according to an exemplary embodiment. The operations and functionalities of flow/velocity feedback controller 530 as described herein may be performed within one or more controllers inside of actuator 502.

Flow/velocity feedback controller 530 is shown to include a processing circuit 902 and a communications interface 908. Communications interface 908 can facilitate communications between wireless communications interface 552, interface 518, and external applications (e.g., user device 602, BMS controller 366, other applications residing on client devices 448) to permit user control, monitoring, and adjustment of functions performed by flow/velocity feedback controller 530. Communications interface 908 may include wired or wireless communications interfaces (e.g., jacks, antennas, transmitters, receivers, transceivers, wire terminals, etc.) for conducting data communications with building subsystems (e.g., building subsystems 428) or other external systems or devices. In various embodiments, communications via interface 908 can be direct (e.g., local wired or wireless communications) or via a communications network (e.g., a WAN, the Internet, a cellular network, etc.). For example, interface 908 can include an Ethernet card and port for sending and receiving data via an Ethernet-based communications link or network. In another example, interface 908 can include a Wi-Fi transceiver for communicating via a wireless communications network. In another example, interface 908 can include cellular or mobile phone communications transceivers. In one embodiment, communications interface 908 is a power line communications interface that is coupled to a BMS interface (e.g., BMS interface 409) that is an Ethernet interface. In other embodiments, both communications interface 908 and the BMS interface are Ethernet interfaces or are the same Ethernet interface.

Still referring to FIG. 9, processing circuit 902 is shown to include a processor 904 and memory 906. Processing circuit 902 can be communicably coupled to communications interface 908 such that processing circuit 902 and the various components thereof can send and receive data via interface 908. Processor 904 can be implemented as a general purpose processor, an application specific integrated circuit (ASIC), one or more field programmable gate arrays (FPGAs), a group of processing components, or other suitable electronic processing components.

Memory 906 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 906 can be or include volatile memory or non-volatile memory. Memory 906 can include database components, object code components, script components, or any other type of information structure for supporting the various activities and information structures described in the present application. According to an example embodiment, memory 906 is communicably connected to processor 904 via processing circuit 902 and includes computer code for executing (e.g., by processing circuit 902 and/or processor 904) one or more processes described herein.

Memory 906 is shown to include mode controller 910, a feedback controller 912, boundary generator 914, data collector 916, curve generator 918, and notification controller 920. Components 910-920 may be configured to receive inputs from user device 602, flow sensor 548, external flow sensor 608, and other data sources (e.g., building subsystems 428). Components 910-920 may also be configured to determine optimal control actions for flow sensor calibration system 600 based on the inputs, generate control signals based on the optimal control actions, and provide the generated control signals throughout flow sensor calibration system 600. The following paragraphs describe some of the general functions performed by each of components 910-920 in flow/velocity feedback controller 530.

Mode controller 910 can be configured to enable the flow sensor calibration system 600 to operate in several modes, including valve command mode, pressure independent mode, calibration mode, or any combination thereof. In some embodiments, mode controller 910 enters calibration mode per user instructions received from user interface 908, which may prompt flow/velocity feedback controller 530 to begin performing a calibration process. In some embodiments, mode controller 910 enters a pressure independent mode prior to, during, or after entering calibration mode. In pressure independent flow control mode, a flow rate setpoint and a measured flow rate are utilized by a feedback controller (e.g., a PVDC) to determine an actuator setpoint that minimizes the error between the measured flow and the flow setpoint, wherein the actuator is configured to modulate valve 546 without substantial changes in pressure. By contrast, in the valve command mode, the actuator 502 is driven to a desired position setpoint regardless of the measured flow rate or pressure within valve 546. In some embodiments, a single mode including pressure-independent operation and a process for calibration is enabled.

Feedback controller 912 can be configured to attempt to achieve a received setpoint. For example, user device 602 provides a maximum flow setpoint for valve 546. Feedback controller 912 sends a valve position command to valve 546 in an attempt to achieve the maximum flow setpoint. In some embodiments, this is performed by sending a signal to drive device 540 to actuate valve 546. In some embodiments, feedback controller 912 may be further configured to modify a pump speed in order to modify a branch inlet pressure, in an attempt to reach the flow setpoint. For example, feedback controller 912 may increase a pump speed in order to increase both the branch inlet pressure and the flow rate of the fluid flowing through the flow sensor calibration system 600.

Boundary generator 914 can be configured to receive or establish boundary conditions for flow measurements from external flow sensor 608 to determine whether flow rate flow measurements received from external flow sensor 608 comply with the boundary conditions. The boundary conditions may be upper and lower values for the maximum flow rate of external flow sensor 608. In various embodiments, the boundary condition values may be set manually by a user or predetermined and stored within boundary generator 914 prior to initializing the calibration test. In some embodiments, boundary generator 914 acts check to ensure that the flow rate through valve 546 is not so high that flow sensor 548 is incapable of accurately measuring the flow, due to maximum sensor specifications. In some embodiments, boundary generator 914 may be excluded from flow/velocity feedback controller 530. If the external flow sensor 608 is used to determine whether maximum flow has been achieved, boundary generator 914 may not be necessary, as the flow measurement will always be within the upper and lower bounds of the flow rate if sensor 608 measured the maximum flow rate.

Data collector 916 may be configured to receive data from one or more sensors (e.g., external flow sensor 608, flow sensor 548, etc.) and/or reference data (e.g., reference flow measurement) from user device 602. Data collector 916 may include a digital filter, such as digital filter 538 as described in FIG. 5A-C, to ensure accurate flow measurements are received.

Curve generator 918 may be configured to calibrate flow sensor 548 in the event that the flow measurement from external flow sensor 608 is within the upper and lower bounds established by boundary generator 914. Curve generator 918 may receive sensor data from flow sensor 548. In some embodiments, curve generator 918 receives both a user-defined reference flow measurement and sensor data from flow sensor 548. In other embodiments, the reference flow measurement is the sensor data from external flow sensor 608. In some embodiments, flow/velocity feedback controller 530 may manipulate or alter the flow measurements received from flow sensor 548 such that the readings received from flow sensor 548 are substantially closer in value to flow measurements received from external flow sensor 608. For example, flow measurements from flow sensor 548 may be received as an input by flow/velocity feedback controller 530 and combined (e.g., added, multiplied, incorporated, etc.) with an equation such that the flow measurements from flow sensor 548 are substantially similar to flow measurements from external flow sensor 608.

In some embodiments, the values from flow sensor 548 are off by a constant factor, and flow/velocity feedback controller 530 compensates for the factor by adjusting (e.g., adding, subtracting, etc.) the values from flow sensor 548 to match the values from external flow sensor 608. In this scenario, the equation combined with the input of flow measurements from flow sensor 548 is an adjustment factor that is added or subtracted to flow measurements from flow sensor 548. For example, five flow measurements are received as inputs to flow/velocity feedback controller 530 from flow sensor 548 reading as 20 gpm, 21 gpm, 25 gpm, 30 gpm, and 30 gpm. Readings from external flow sensor 608 measured the flow rate at the same intervals of time and received five measurements: 40 gpm, 41 gpm, 45 gpm, 50 gpm, and 50 gpm. Based on the difference between the two sets of flow measurements, an adjustment factor of 20 gpm needs to be added to the flow measurements from flow sensor 548 for proper calibration.

In some embodiments, the values from flow sensor 548 are off by a variable factor, and flow/velocity feedback controller 530 compensates for the factor by incorporating the flow measurements from flow sensor 548 into an equation for calibration. This equation my act as a scaling factor, an offset, a polynomial equation, or any combination thereof. For example, five flow measurements are received as inputs to flow/velocity feedback controller 530 from flow sensor 548 reading as 5 gpm, 6 gpm, 5 gpm, 5 gpm, and 7 gpm. Readings from external flow sensor 608 measured the flow rate at the same intervals of time and received five flow measurements: 20 gpm, 24 gpm, 20 gpm, 20 gpm, and 28 gpm. Based on the difference between the two sets of flow measurements, a scaling factor of "4" needs to be multiplied to the flow measurements from flow sensor 548 for proper calibration.

In another embodiment, the equation may include both a scaling factor and an adjustment factor. For example, five flow measurements are received as inputs to flow/velocity feedback controller 530 from flow sensor 548 reading as 4 gpm, 5 gpm, 7 gpm, 3 gpm, and 5 gpm. Readings from external flow sensor 608 measured the flow rate at the same intervals of time and received five flow measurements: 16 gpm, 19 gpm, 25 gpm, 13 gpm, and 19 gpm. Based on the difference between the two sets of flow measurements, a scaling factor of "3" needs to be multiplied and an adjustment factor of 4 gpm needs to be added to the flow measurements from flow sensor 548 for proper calibration. In this scenario, the equation is linear (e.g., Ax+B), however the equation may by any type of polynomial (e.g., power, cubic, quadratic, rational, exponential, logarithmic, sinusoidal, etc.).

Calibration data generator 922 may receive both sensor data from flow sensor 548 and reference data (e.g., reference flow measurement) from user device 602 or external flow sensor 608, as shown in FIG. 9. A reference flow measurement may be used to generate a coefficient or function such that, combining the flow measurement from flow sensor 548 with the coefficient or function transforms the flow measurement from flow sensor 548 to the value of the reference flow measurement. This process may be done with one or more flow measurements from flow sensor 548 and/or one or more reference flow measurements. In some embodiments, the calibration process as outlined in FIGS. 7A-C for flow sensor 548 is performed within curve generator 918.

Regression generator 924 may be configured to receive multiple different flow measurements from the flow sensor 548 and multiple different reference flow values are used to generate a regression model. The regression model may be used to predict the necessary scaling (e.g., adjustment factor, equation, etc.) to transform a flow measurement from flow sensor 548 to the value of a reference flow measurement. Scaling of one or more values from flow sensor 548 that may be used to generate a model (e.g., regression model) for calibrating flow sensor 548 includes but is not limited to:

$$y=Ax \tag{1}$$

$$y=x+B \tag{2}$$

$$y=Ax+B \tag{3}$$

Where x is the flow measurement from flow sensor 548, y is the reference flow value, and A/B are coefficients to scale the flow measurement from flow sensor 548 to the reference flow measurement. The model may also include non-linear equations (e.g., quadratic, cubic, etc.) or any type of equation mentioned with reference to curve generator 918. In some embodiments, the regression model incorporates regression analysis to estimate the relationship between the dependent variable (e.g., flow measurements from flow sensor 548) and independent variable (e.g., reference flow measurements).

In various embodiments, the reference flow measurement and the flow measurements from flow sensor 548 have identical units. For example, flow sensor 548 may receive a flow measurement of 20 gallons per minute, whereas a reference flow value may be 25 gallons per minute. The units for the flow measurements from flow sensor 548 and the reference flow measurements may differ in conversion factors. For example, flow sensor 548 may receive a flow measurement of 20 gallons per minute, whereas a reference flow value may be 0.33 gallons per second. In various embodiments, the units for both the flow sensor 548 and external flow sensor 608 may be any suitable units of flow rate (e.g., gpm, litres per minute, litres per second) in any suitable system (e.g., imperial system, metric system, etc.).

In some embodiments, regression generator 924 may implement regression analysis to predict (e.g., forecast) future calibration adjustments, based on past sets of data. For example, the calibration process for flow sensor 548 may have been performed a substantial number of times (e.g., greater than 10 times). In the event of the $11^{th}$ time flow sensor 548 is being calibrated, a substantial amount of data has been recorded that may allow for predicted calibration of flow sensor 548.

Notification controller 920 may be configured to notify building occupants of a potential issue within system 600. For example, in the event that maximum flow is not achieved during the calibration test, a notification (alarm, warning signal, etc.) may be sent to one or more building controllers (e.g., BMS controller 366, controller 504, etc.) or user devices (e.g., user device 602) to notify the building occupants of any and all problems occurring within system 600.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A method for calibrating a flow sensor in a heating, ventilation, or air conditioning (HVAC) system, the method comprising:

receiving, at a controller comprising one or more processors and one or more memory devices storing instructions thereon, a request to enter a calibration mode;

in response to receiving the request, automatically commanding a pressure independent flow control device to achieve a target flow rate, the pressure independent flow control device operable by the controller to adjust a flow rate of a fluid through a fluid conduit, wherein automatically commanding the pressure independent flow control device to achieve the target flow rate comprises operating the pressure independent flow control device in a pressure-independent control mode comprising: (i) providing the target flow rate as a flow setpoint and (ii) operating the pressure independent flow control device to adjust the flow rate of the fluid through the fluid conduit while monitoring measurements of the flow rate of the fluid to determine whether the flow rate of the fluid is approaching the target flow rate; and in response to determining that the pressure independent flow control device has achieved the target flow rate, generating, by the controller, calibration data for the flow sensor using a reference flow value of the flow rate and a corresponding flow measurement from the flow sensor.

2. The method of claim 1, further comprising operating the pressure independent flow control device using one or more additional flow measurements from the flow sensor and the calibration data.

3. The method of claim 1, wherein automatically commanding the pressure independent flow control device to achieve the target flow rate comprises commanding the pressure independent flow control device to achieve a maximum flow rate measurable by the flow sensor.

4. The method of claim 1, further comprising obtaining the reference flow value from a pre-calibrated sensor positioned to measure the flow rate of the fluid through the fluid conduit when the pressure independent flow control device has achieved the target flow rate.

5. The system of claim 1, wherein automatically commanding the pressure independent flow control device to achieve the target flow rate comprises commanding the pressure independent flow control device to achieve a plurality of different target flow rates;

wherein the reference flow value comprises a plurality of reference flow values corresponding to the plurality of different target flow rates.

6. The system of claim 1, wherein at least one of the request to enter the calibration mode or the reference flow value are received from a user via a user interface.

7. The method of claim 1, wherein generating the calibration data comprises calculating an adjustment factor that transforms the flow measurement from the flow sensor into the reference flow value.

8. A flow sensor calibration system comprising:

a pressure independent flow control device;

a flow sensor; and a controller comprising one or more processors and one or more memory devices storing instructions that, when executed by the one or more processors, cause the one or more processors to:

receive a request to enter a calibration mode;

in response to receiving the request, automatically command the pressure independent flow control device to achieve a target flow rate, the pressure independent flow control device operable by the controller to adjust a flow rate of a fluid through a fluid conduit, wherein automatically commanding the pressure independent flow control device to achieve the target flow rate comprises operating the pressure independent flow control device in a pressure-independent control mode comprising: (i) providing the target flow rate as a flow setpoint and (ii) operating the pressure independent flow control device to adjust the flow rate of the fluid through the fluid conduit while monitoring measurements of the flow rate of the fluid to determine whether the flow rate of the fluid is approaching the target flow rate; and in response to determining that the pressure independent flow control device has achieved the target flow rate, generate, by the controller, calibration data for the flow sensor using a reference flow value of the flow rate and a corresponding flow measurement from the flow sensor.

9. The system of claim 8, wherein the controller is further configured to operate the pressure independent flow control device using one or more additional flow measurements from the flow sensor and the calibration data.

10. The system of claim 8, wherein automatically commanding the pressure independent flow control device to achieve the target flow rate comprises commanding the flow control device to achieve a maximum flow rate measurable by the flow sensor.

11. The system of claim 8, wherein automatically commanding the pressure independent flow control device to achieve the target flow rate comprises commanding the pressure independent flow control device to achieve a plurality of different target flow rates;

wherein the reference flow value comprises a plurality of reference flow values corresponding to the plurality of different target flow rates.

12. The system of claim 8, wherein the controller is further configured to obtain the reference flow value from a pre-calibrated sensor positioned to measure the flow rate of the fluid through the fluid conduit when the pressure independent flow control device has achieved the target flow rate.

13. The system of claim 8, wherein at least one of the request to enter the calibration mode or the reference flow value are received from a user via a user interface.

14. The system of claim 8, wherein generating the calibration data comprises calculating an adjustment factor that transforms the flow measurement from the flow sensor into the reference flow value.

15. A flow controller comprising a memory storing instructions that, when executed by a processor, cause the processor to:

receive a request to enter a calibration mode;

in response to receiving the request, automatically command a pressure independent flow control device to move into a predetermined position corresponding to a target flow rate, the pressure independent flow control device operable by the flow controller to adjust a flow rate of a fluid through a fluid conduit, wherein automatically commanding the pressure independent flow control device to move into the predetermined position comprises operating the pressure independent flow control device in a pressure-independent control mode comprising: (i) providing the target flow rate as a flow set point and (ii) operating the pressure independent flow control device to adjust the flow rate of the fluid through the fluid conduit while monitoring measurements of the flow rate of the fluid to determine whether the flow rate of the fluid is approaching the target flow rate; and in response to a determination that the pressure independent flow control device has achieved the predetermined position corresponding to the target flow rate, generate, by the flow controller, calibration data for a flow sensor using a reference flow value of the flow rate and a corresponding flow measurement from the flow sensor.

16. The flow controller of claim 15, wherein the instructions cause the processor to operate the pressure independent flow control device using one or more additional flow measurements from the flow sensor and the calibration data.

17. The flow controller of claim 15, wherein automatically commanding the pressure independent flow control device to move into the predetermined position comprises commanding the pressure independent flow control device to move into a maximum flow position.

18. The flow controller of claim 15, wherein the instructions cause the processor to obtain the reference flow value from a pre-calibrated sensor positioned to measure the flow rate of the fluid through the fluid conduit when the pressure independent flow control device is at the predetermined position.

19. The flow controller of claim 15, wherein receiving the request to enter calibration mode comprises receiving the request from a user via a user interface.

20. The flow controller of claim 15, wherein the instructions cause the processor to receive the reference flow value from a user via a user interface.

* * * * *